United States Patent [19]

Miller et al.

[11] 4,334,337

[45] Jun. 15, 1982

[54] COMPACT WET-DRY ELECTRIC VACUUM CLEANER

[75] Inventors: Jonathan Miller; Richard Fegan, both of Williamsport; Robert C. Berfield, Jersey Shore; Kenneth R. Hiester, Cogan Station; Rudolph W. Wacek, Montoursville, all of Pa.

[73] Assignee: Shop-Vac Corporation, Williamsport, Pa.

[21] Appl. No.: 134,776

[22] Filed: Mar. 28, 1980

[51] Int. Cl.[3] ..... A47L 5/32

[52] U.S. Cl. ..... 15/326; 15/331; 15/334; 15/337; 15/339; 15/352; 15/353; 15/410; 15/413

[58] Field of Search ..... 15/320, 321, 322, 326, 15/331, 334, 337, 339, 352, 353, 410, 413

[56] References Cited

U.S. PATENT DOCUMENTS

| | | | |
|---|---|---|---|
| 2,522,882 | 9/1950 | Lofgren | 15/352 X |
| 2,635,277 | 4/1953 | Belknap | 15/322 |
| 3,055,161 | 9/1962 | Hallstrom | 15/352 X |
| 3,056,994 | 10/1962 | Noble | 15/353 X |
| 3,142,857 | 8/1964 | Fresard et al. | 15/330 X |
| 3,277,511 | 10/1966 | Little et al. | 15/353 X |
| 3,277,512 | 10/1966 | Waters | 15/337 X |
| 3,484,890 | 12/1969 | Case | 15/413 X |
| 3,939,527 | 2/1976 | Jones | 15/320 X |
| 3,974,541 | 8/1976 | Silvis et al. | 15/320 |
| 4,068,340 | 1/1978 | Forward | 15/321 |
| 4,114,229 | 9/1978 | Jones et al. | 15/320 |
| 4,114,231 | 9/1978 | Nauta | 15/321 X |
| 4,167,800 | 9/1979 | Tribolet | 15/331 |
| 4,216,563 | 8/1980 | Cyphert | 15/321 |
| 4,227,316 | 10/1980 | Schneider | 15/322 X |

FOREIGN PATENT DOCUMENTS 1208457 1/1966 Fed. Rep. of Germany ..... 15/334

*Primary Examiner*—Chris K. Moore

*Attorney, Agent, or Firm*—Ostrolenk, Faber, Gerb & Soffen

[57] ABSTRACT

The disclosure concerns a compact wet-dry vacuum cleaner adapted for collecting both wet and dry materials. The vacuum cleaner is powered by a by-pass type blow motor which is supported in a housing. The housing includes a baffle for separating the inflowing cooling air to the motor from the outflowing air which has cooled the motor. The placement of inlets and outlets to the motor housing prevents debris and liquid from splashing on the motor. A materials collection tank is separably attached to the motor housing to enable the tank to be removed for cleaning. The tank includes a nozzle at its front wall, which nozzle has an exit near the top of the tank. A curved air flow redirector at the top of the tank separates collected material from the air. The outlet from the tank is laterally spaced from the flow redirector. The motor housing is attached to a swivelable cover that extends over the motor. The cover extends over a duct that communicates between the materials collection tank and the blow motor. The cover is latched closed to the collection tank for forming the complete vacuum cleaner. Access to the tank is obtained by raising the cover off the tank. A power regulator at the duct determines the flow rate of the air being sucked into the suction inlet. A handle, swivelable to various positions during use and storage, is connected to the cover.

83 Claims, 61 Drawing Figures

ON
OFF

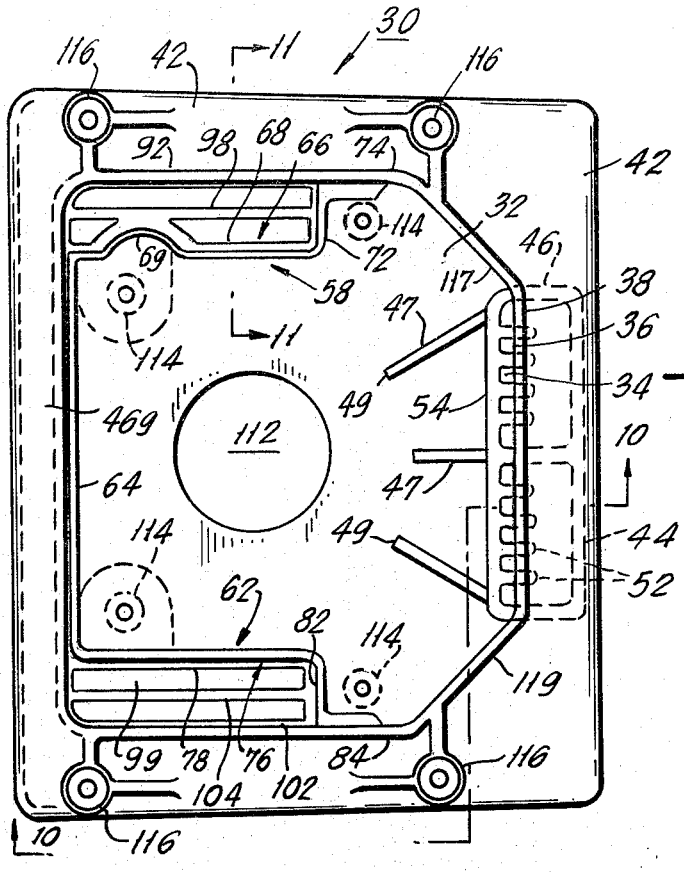
FIG. 9.
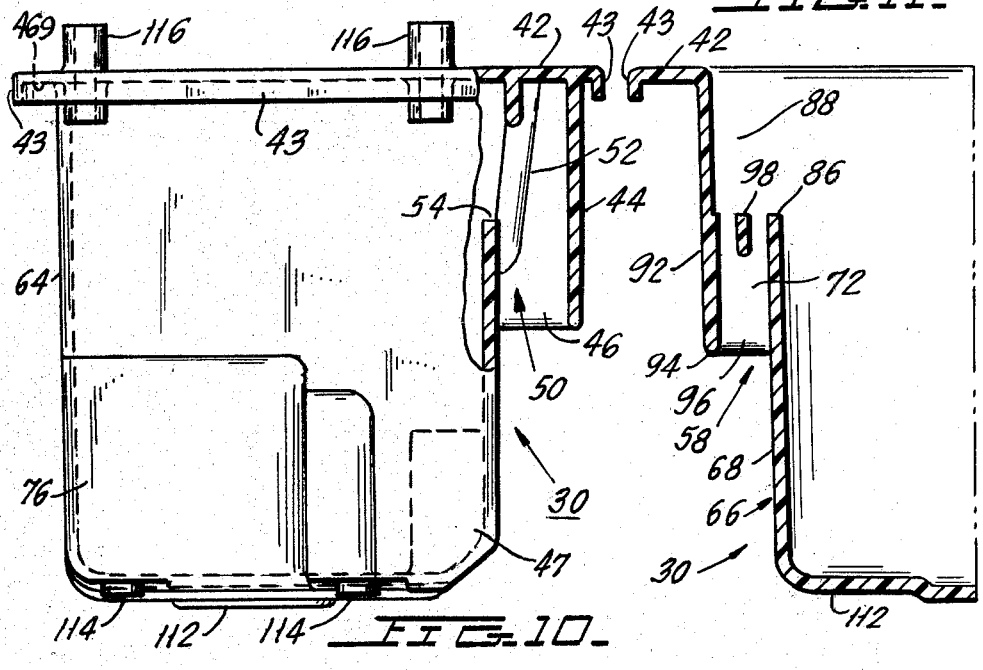
FIG. 10.
FIG. 11.

FIG. 13.
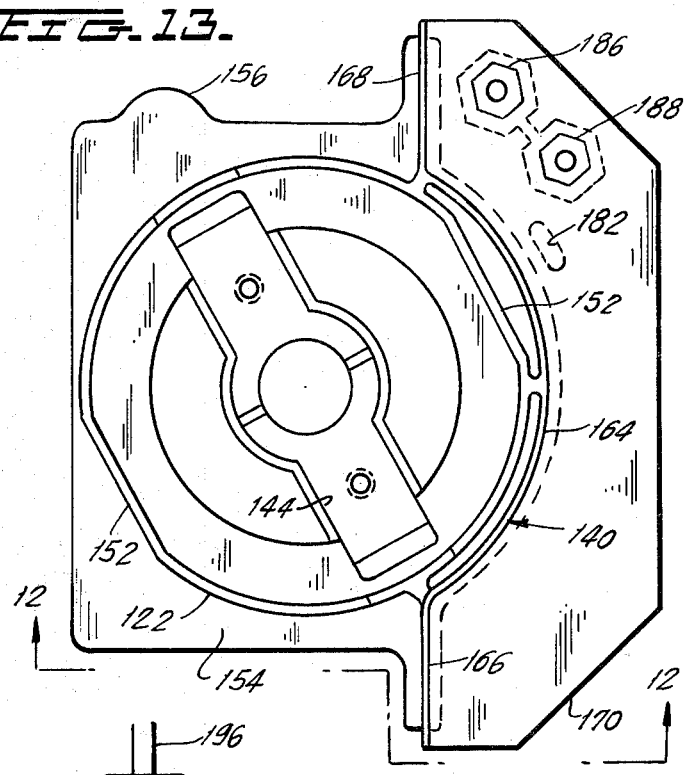
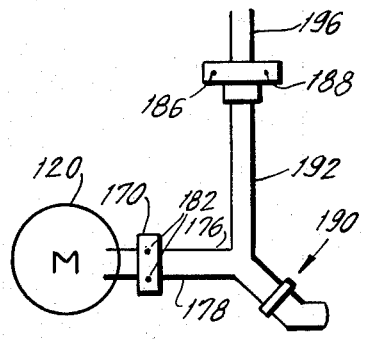
FIG. 15.
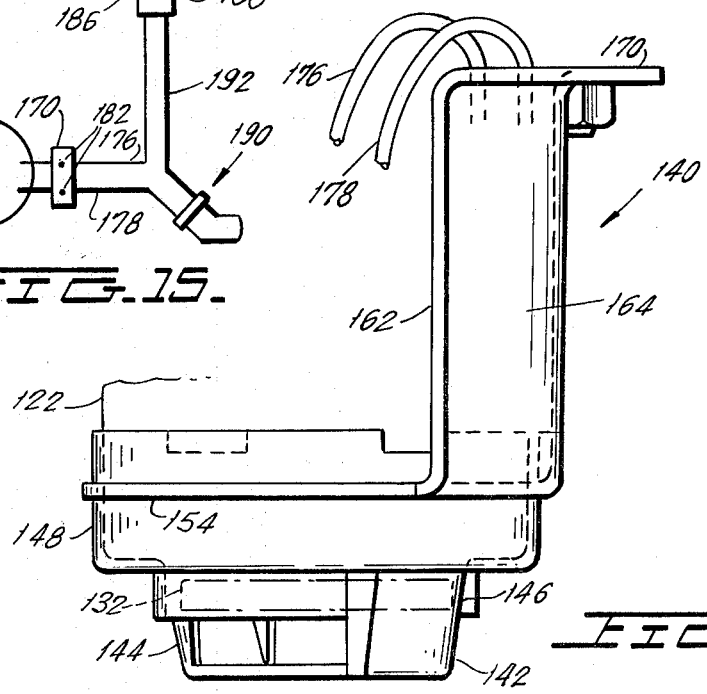
FIG. 12.

FIG. 23.
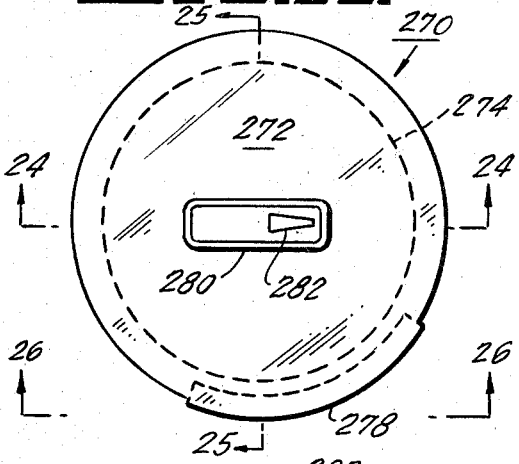
FIG. 25.
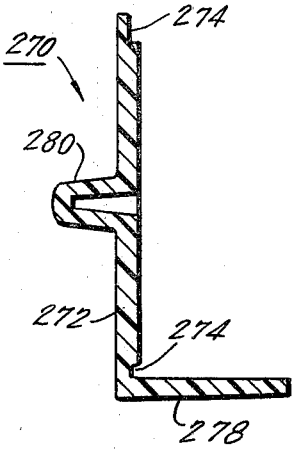
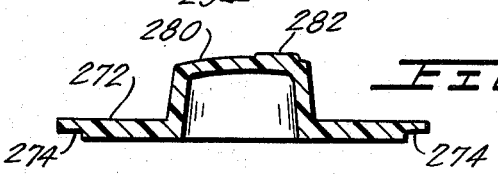
FIG. 24.
FIG. 26.
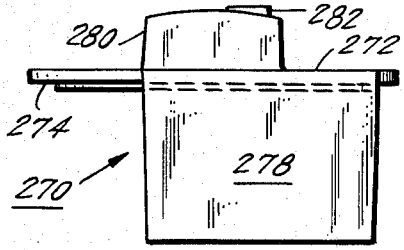
FIG. 27.
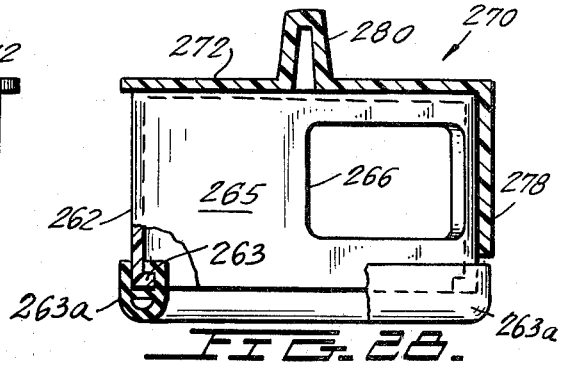
FIG. 21.
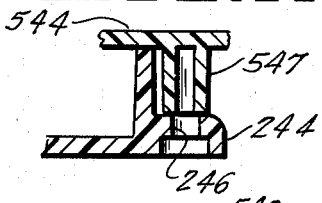
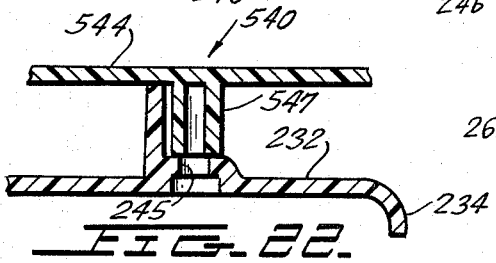
FIG. 22.
FIG. 28.
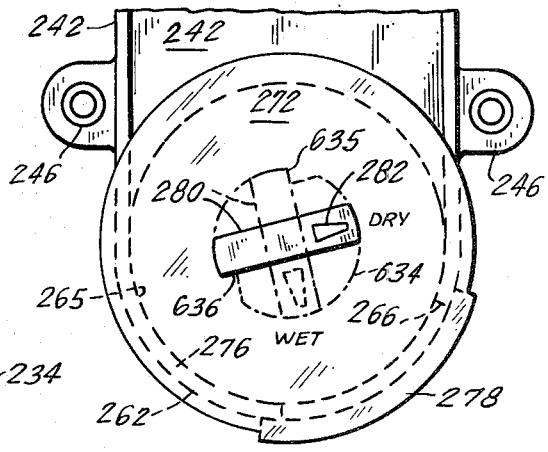

300
352
354
350
303
310
386
302
304
520
532
311
312
340
328
576
579
580
596
597
598
599
578
624

754
766
772
690
758
780
770
762
759
788
57a
764
782
59
784
786
765
768
692
696
694
812
684
686
660
577
586
588
594
592
584
602
626
610
606
612
607
604
370
366
540
544
562
549
720
116
42
790
792
794
761
58
662
744
726
680
538
742
740
738
668
736
664
730
732
670
678
674
734

FIG. 53.
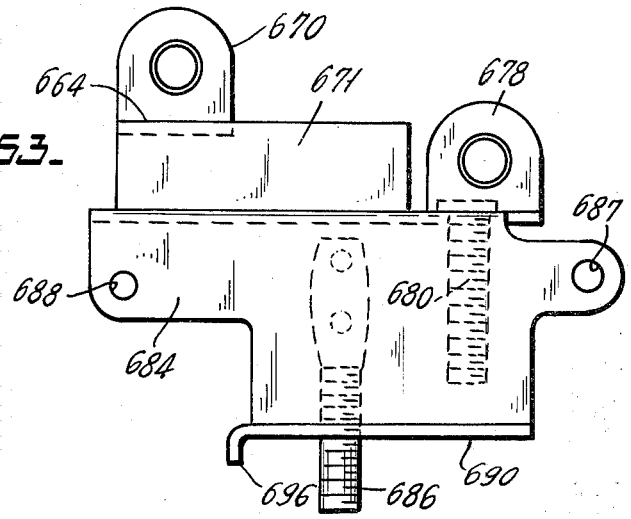
FIG. 51.
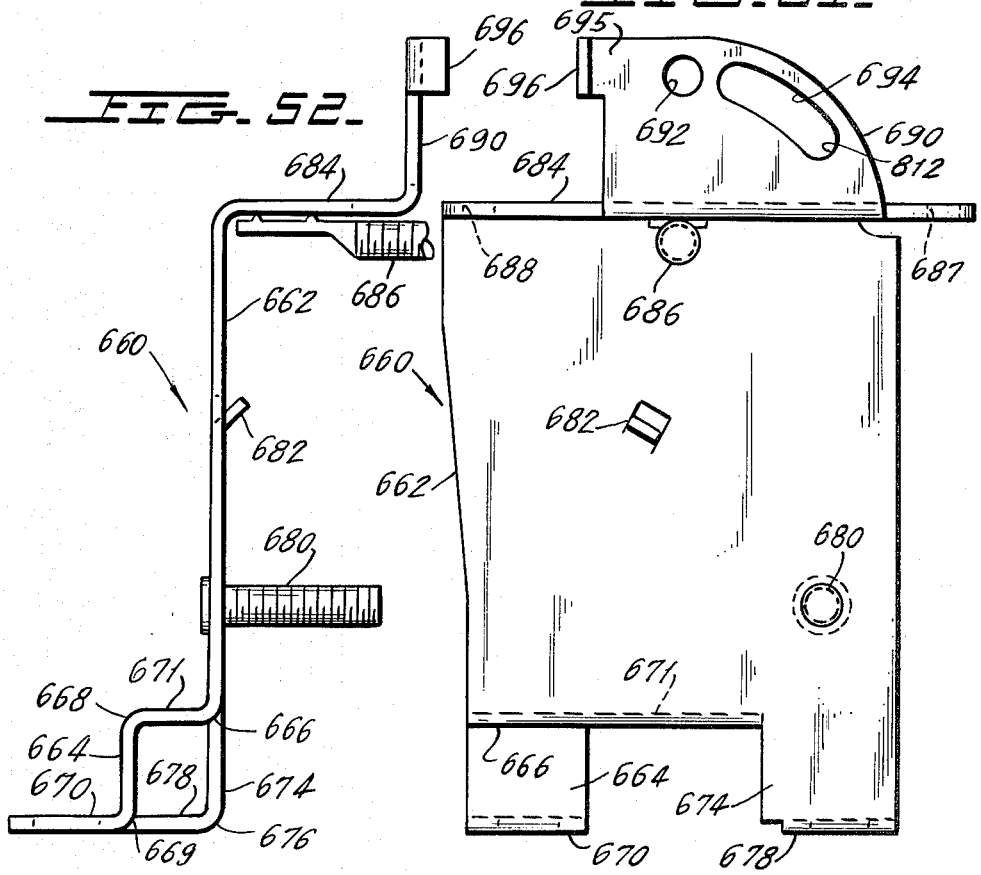
FIG. 52.

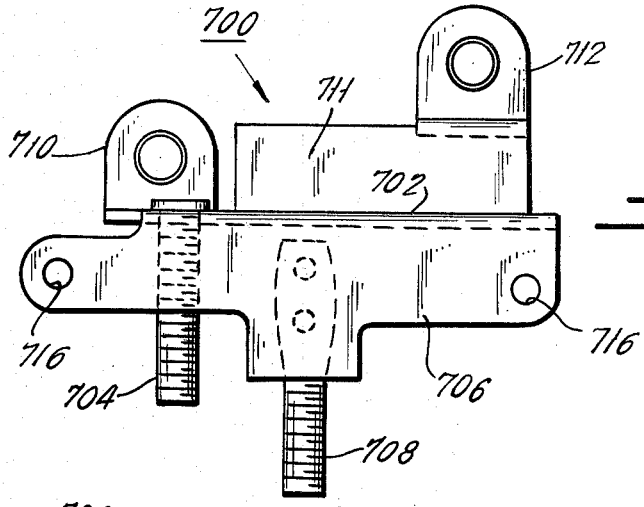
FIG. 56.
FIG. 54.
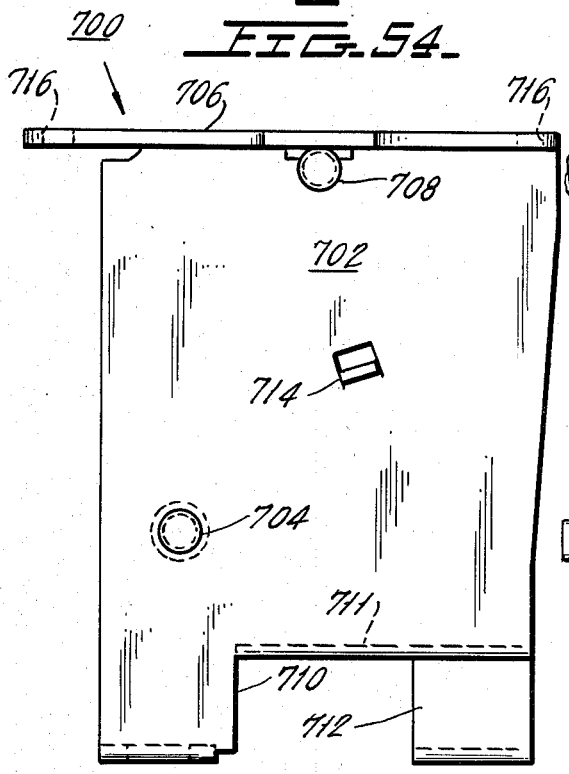
FIG. 55.
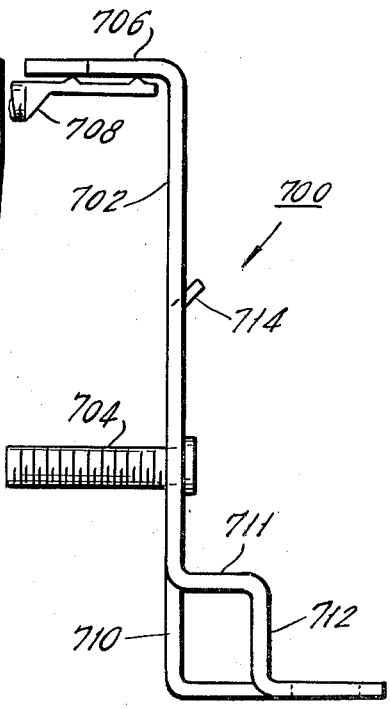

COMPACT WET-DRY ELECTRIC VACUUM CLEANER

BACKGROUND OF THE INVENTION

The present invention relates to an electric vacuum cleaner, particularly adapted for collecting dry material, wet material and even liquid. In particular, the invention relates to a compact wet-dry vacuum cleaner.

Electric vacuum cleaners for collecting wet and dry materials and liquid are well known. Many of these wet-dry vacuum cleaners are cannister types, with a relatively stationary cannister in which materials are collected and with a hose leading to a suction wand being used for collecting the materials. For ease of storage and compactness, it is desirable to provide a small sized vacuum cleaner capable of collecting wet and dry material, which is easy to handle.

Conventional upright vacuum cleaners include the materials collection means, the vacuum or suction motor, the collected materials receptacle and the upright handle for moving the vacuum cleaner, all in one unit. They are not usually well adapted for collecting both wet and dry material. Wet material, particularly liquid, might undesirably contact the electric motor or the electrical connections to the motor, damaging the motor. Typically, known upright vacuum cleaners do not have a receptacle suitable for collecting wet materials or liquids.

Compact, light weight vacuum cleaners which are supported on a long handle and are moved along the surface to be cleaned are known as electric brooms. These are not as strong as or as heavy as upright vacuum cleaners and are not as effective for cleaning carpeting. These vacuum cleaners also are not well adapted for collecting wet material or liquids and also may not have a collection receptacle for these.

In addition, when a vacuum cleaner collects certain materials, particularly wet materials or dirty liquids, the collection receptacle becomes quite dirty. Known vacuum cleaners have a receptacle that is difficult to remove and clean, or in the case of conventional upright vacuum cleaners and electric broom vacuum cleaners, there is no means for cleaning and replacing the receptacle, and wet material or liquids would severely damage the receptacle and make it unusable. Furthermore, ease of removal of a collected materials receptacle for cleaning, especially where the receptacle is intended for reuse, is important.

SUMMARY OF THE INVENTION

Accordingly, it is the primary object of the present invention to provide an effective wet-dry vacuum cleaner.

It is another object of the present invention to provide such a vacuum cleaner which is relatively compact.

It is a further object of the present invention to provide such a vacuum cleaner where the receptacle for collected materials is adapted for easy removal for cleaning, or the like.

Other objects are to minimize stressing of the blower fan motor, obtain quiet operation, provide an esthetically pleasing unit, and to reduce the risk of damage due to splashing of materials being collected by the vacuum cleaner.

According to the present invention, a compact wet-dry vacuum cleaner is provided. Generally, the vacuum cleaner is comprised of a main blower fan and a motor for driving the blower fan. The blower fan motor is supported in a motor housing. A separate tank for collected materials is positioned near to the motor housing and is separably attached thereto by separable attachment means extending between the tank and the housing. The tank can thereby be separated from the motor housing for removal for emptying, cleaning, and the like. The separable attachment is comprised of a hook projecting from the tank to the housing and an appropriate means on the housing for receiving and supporting the hook.

The suction inlet to the vacuum cleaner is in communication with the tank. The tank has an inlet nozzle. The nozzle has an inlet at the bottom of the tank at the suction inlet and the nozzle extends up the front wall of the tank to a nozzle exit near the top of the tank. The inlet nozzle is shaped for obtaining uniform air flow velocity over the width of the suction inlet, through appropriate narrowing of the cross-section of the nozzle moving out toward the sides of the tank. The nozzle exit is a relatively narrow cross-section opening near the top of the tank.

Immediately to the rear of the suction inlet, beneath the tank, an appropriate brush is provided for directing materials into the suction inlet. The brush is adapted to move particulate materials, particularly dry materials and also wet materials, as well as liquid, toward the suction inlet.

The tank has a cover over it. The cover includes flow redirecting means in it for directing the flow of collected materials on a redirected, preferably curved pathway which causes the collected materials to separate from the air. The air outlet from the tank is at the top of the tank and passes through the top wall thereof. The outlet is spaced from the flow redirecting means and from the nozzle exit into the tank. The tank also has an auxiliary inlet for a hose. Selection means determines whether inlet to the tank shall be through the floor nozzle or through the auxiliary hose. The suction inlet is located beneath a short height, forwardly projecting portion of the tank, adapted to extend under low furniture, etc.

The blower fan motor housing is located to the rear of the tank. The motor for the blower fan is a bypass blow motor, where there is a separate cooling flow for cooling the motor and that separate cooling flow is separated from the flow of air that runs through the main blower fan. Baffle means inside the motor housing separate the cooling air flowing in to the housing from the motor cooling air that has passed over the motor and is leaving the housing. The cooling air inlet and outlet of the motor housing are located high up on the motor housing to prevent liquid splashing on the motor and to minimize the amount of debris that will enter the motor. The inlet for cooling air to the motor housing is at the rear of the motor housing which is at the rear of the vacuum cleaner. Ambient air is drawn in to cool the blower fan motor, thereby preventing damage to the motor from contaminated air. The cooling air exhausting from the motor housing is blown down both sides of the motor housing behind the wheels of the vacuum cleaner.

The main blower fan of the vacuum cleaner is above the housing. It is preferably a centrifugal fan. Duct means communicate between the outlet to the tank and the inlet to the centrifugal fan. The duct means include a plate and sidewalls upstanding from the plate. The cover over the vacuum cleaner meets the sidewalls and closes off the duct. All of the motor housing, duct and cover are secured together as one unit.

The cover extends over the blower fan motor housing and over the duct and is large enough to also cover the tank. The cover is movable between a position where it covers the tank and a position where it is tilted back off the tank. Latch means latch the cover closed for covering the tank. When the cover is upraised, the tank can be easily removed for cleaning, or the like.

In the duct means, a power regulator is provided for selectively closing off flow from the tank to the blower fan to a varying extent, thereby for varying the suction power of the vacuum cleaner. The power regulator also communicates with the ambient air under the cover of the vacuum cleaner, so that flow to the blower fan may be at a constant rate and to the extent that flow from the tank is diminished, the flow of ambient air is proportionately increased. This prevents stressing of the blower fan motor.

Support means, e.g. rollers, are positioned beneath both the tank and the housing for spacing the suction inlet off the surface to be vacuum cleaned and also so that both the tank and the motor housing provide support for the vacuum cleaner on the surface to be cleaned.

A handle by which the vacuum cleaner is moved is attached to the cover in a manner which enables the handle to swivel as the vacuum cleaner is used normally. Furthermore, latching means are provided for latching the handle in a fixed position for storage of the vacuum cleaner.

Other objects and features of the invention will be apparent from the following detailed description of a preferred embodiment of the invention considered in conjunction with the accompanying drawings.

BRIEF DESCRIPTION OF THE DRAWINGS

FIG. 9 is a top view of the blower fan motor housing, with the motor and fan absent;

FIG. 10 is a side view of the housing shown in FIG. 9, viewed partially in cross-section, along the line 10—10 of FIG. 9;

FIG. 11 is a fragmentary, cross-sectional elevational view of the housing along the line 11—11 in FIG. 9;

FIG. 12 is a side elevational view of the baffle means located in the blower fan motor housing, as viewed along the line 12—12 in FIG. 13;

FIG. 13 is a top view of the baffle means of FIG. 12;

FIG. 15 is a schematic electric circuit diagram showing the electrical connections to the blower fan motor;

FIG. 21 is a fragmentary cross-sectional view of the plate and duct shown in FIG. 18 along the line 21—21 in FIG. 18;

FIG. 22 is a fragmentary cross-sectional view in the direction of arrows 22—22 of FIG. 18;

FIG. 23 is a plan view of the power regulator associated with the plate and duct for regulating the suction force of the vacuum cleaner;

FIG. 24 is a cross-sectional view of the power regulator along the line 24—24 of FIG. 23;

FIG. 25 is another cross-sectional view of the power regulator along the line 25—25 of FIG. 23;

FIG. 26 is a side view of the power regulator shown in FIG. 23 viewed in the direction of arrows 26—26 in FIG. 23;

FIG. 27 is a side view showing the end of the duct and showing the power regulator broken away for demonstrating the relationship between them;

FIG. 28 is a plan view of the duct at the power regulator and showing the power regulator;

FIG. 51 is an elevational view of one of the side brackets used for connecting the motor housing, duct and cover over the vacuum cleaner together and for serving as an axle for the vacuum cleaner and a support for the handle for the vacuum cleaner;

FIG. 52 is a side view of the bracket shown in FIG. 51;

FIG. 53 is a top view of the bracket shown in FIG. 51;

FIG. 54 is a elevational view of the bracket on the opposite side of the vacuum cleaner;

FIG. 55 is a side view of the bracket shown in FIG. 54;

FIG. 56 is a top view of the bracket shown in FIG. 54;

DESCRIPTION OF A PREFERRED EMBODIMENT

Figure 1:
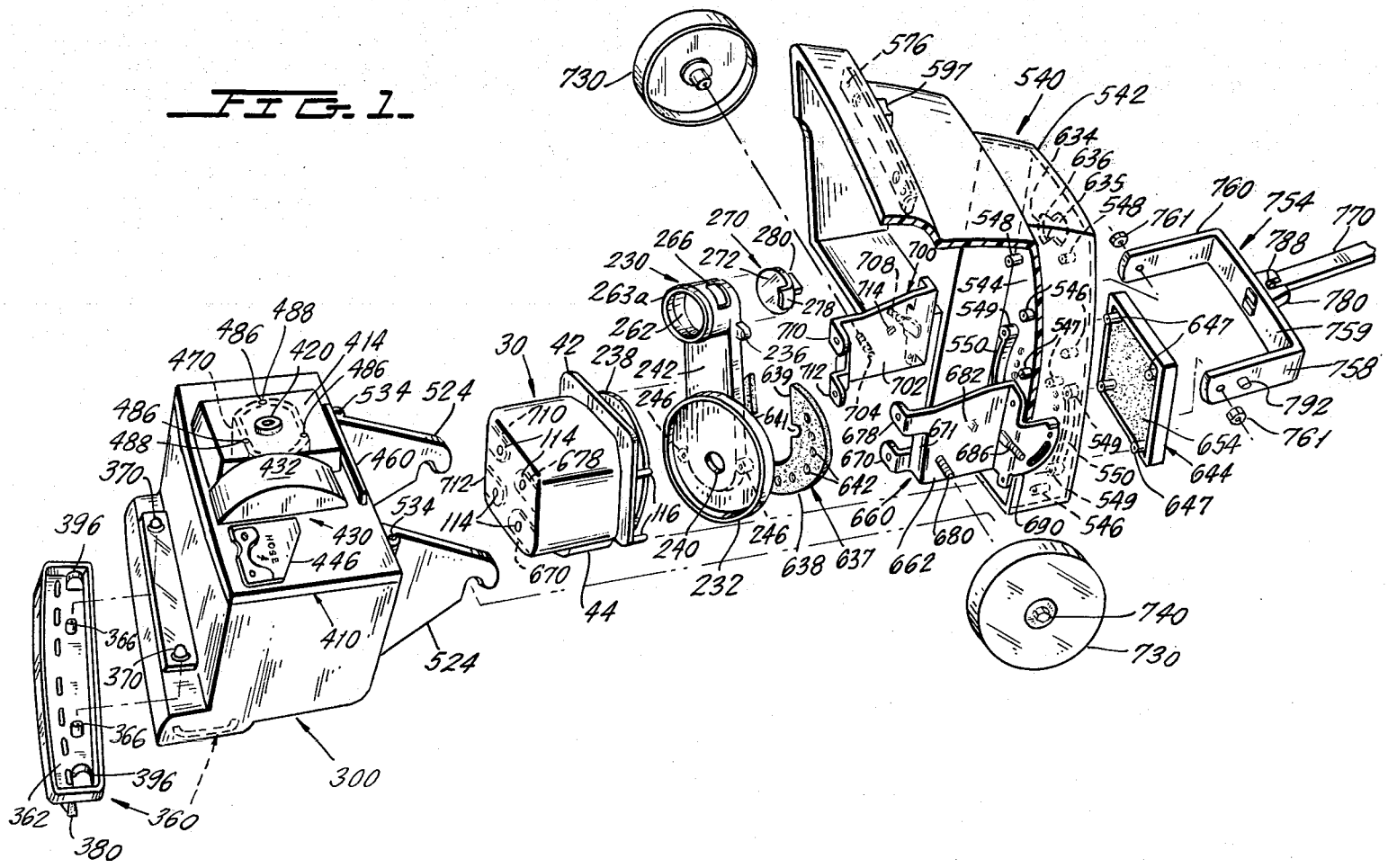
FIG. 1 is an exploded perspective view of a preferred embodiment of the wet-dry vacuum cleaner according to the present invention.
Figure 2:
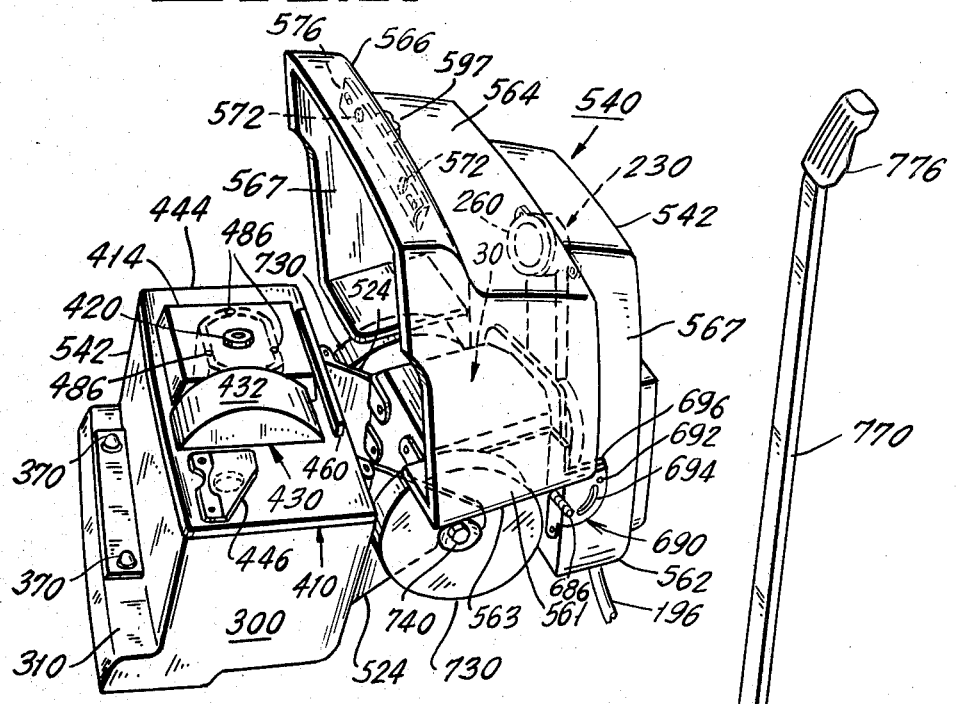
FIG. 2 is a side perspective view showing the vacuum cleaner in the cover open condition.

A vacuum cleaner according to the present invention is shown in the drawing Figures. The vacuum cleaner includes a main blower fan 126 which is driven by a blower motor 120. The blower motor 120 is supported in the blower motor housing 30. A tank 300 for collected materials communicates with the blower fan 126. The tank has a suction inlet at the floor plate 360 beneath the front of the tank. An inlet nozzle 310-350 extends up the front wall of the tank and exits near the top cover 410 of the tank. The flow redirecting means 432 in the cover redirects the collected materials to fall into the tank. Air is suctioned through the outlet 420 of the tank which is protected by the filter 470, 490. Communication between the tank outlet 420 and the inlet opening 240 leading to the center of the centrifugal blower fan 126 is by means of the duct defined above the mounting plate assembly 230. A power regulator 270 determines the extent to which the full power of the fan 126 sucks air out of the tank and combines that tank air with ambient air from beneath the cover 540 in a variable ratio, thereby adjusting the suction power of the vacuum cleaner.

A cover 540 extends over the top of the mounting plate 230 and closes the top of the duct 240, 242. Brackets 660, 700 securely hold the motor housing 30 beneath the mounting plate 230 and hold the mounting plate securely under the cover 540, making the subassembly of the motor housing 30, mounting plate 230 and cover 540 an integral unit. The brackets 660, 700 are supported at the axles 680, 704, on the wheels 730. The cover 540 is swivelable about the axles 680, 704 between an opened positioned, which gives access to the tank 300 and a closed position where the front of the cover 540 is latched by latch means 576-626 to the tank.

The centrifugal air flow from the fan 126 is directed up through a vibration damping, air velocity reducing and thus sound muffling foam material element 637 beneath the top wall 544 of the cover 540, through holes 545 in the cover wall 544, through another air velocity reducing, sound muffling foam material element 654 outside the holes 545 in the cover and then laterally out from under an exhaust cover 644 over these.

The tank 300 is intended to be removable from the vacuum cleaner to enable the tank to be emptied, cleaned and replaced. To this end, the tank has a pair of hooks 524 at its rear which hooks are supported on the axles 680, 704 inboard of the wheels 730. The rollers 404 beneath the floor plate 360 at the suction inlet cooperate with the hooks 524 in supporting the tank in its movement across the surface to be cleaned. The housing 30 and cover 540 are supported for movement across that surface by the wheels 730.

A handle comprising the yoke 754 and a handle 770 supported by the yoke is also attached to the brackets 660, 700 at the pivots 687. The guide flange 690 on the bracket 660 cooperates with the spring pin 794 of the detent means 790 supported on the yoke 754 for establishing various tilt positions for the handle and yoke with respect to the cover 540.

The individual features and sub-assemblies of the apparatus, briefly mentioned just above, are now considered in detail.

With reference to FIGS. 7-11, the motor housing 30 is open at the top at 32 for receiving the motor 120 therein. As shown in FIG. 9, the housing has a generally rectangular configuration in plan view, with its rearward edges chamfered for reasons described below. The housing 30 has been designed to permit maximum through passage of cooling air for cooling the motor 120 in the housing, while simultaneously preventing the entrance of water or particulate impurities or debris into the motor housing.

The inlet side wall 34 of the housing faces toward the rear of the vacuum cleaner. Extending laterally across the full width of the top section of the inlet side wall 34, there is a rectangular opening 36 for entrance of cooling air. The entrance opening 36 for cooling air is located near the top 32 of the housing 30 to prevent entrance into the housing through that opening of particulate material or liquid that may be splashed up into the housing during use of the vacuum cleaner. Above the opening 36 at the top of the wall 34, there is an outwardly projecting support section or shelf 42. The shelf 42 extends around three of the four sides of the housing 30. The shelf 42 has a depending lip 43 at its edge.

A covering wall 44 depends down far enough from the shelf 42 for inhibiting direct mechanical access into the hole 36. The depending wall 44 extends across the full width of the opening 36 and the wall 44 terminates at side margins 46 which extend in toward the rear wall 34 of the housing. Elements 42, 44, 46 close off the access into the inlet 36 and assure that the only entrance into that inlet is through the opening 50 at the bottom of the wall 44. This prevents the user's fingers or debris, etc. from entering the housing inlet opening 36.

The closely spaced, parallel, rearwardly projecting ribs 52 extend down from the shelf 42 past the bottom 54 of the opening 36 for preventing the entrance of large objects into the motor housing.

In the housing 30, beneath the opening 36, there are secured to the housing wall 34 vertically upstanding panels 47 for obstructing the electric lead wires 176, 178, described below or any large objects from falling into the motor housing and particularly for keeping the wires, etc. away from the end bell 142 at the entrance to the cooling fan. The panels 47 have inward ends 49 that are spaced from the exterior of the baffle portion 164 to the below described baffle 140 so that the vibration of the motor is not transmitted to the housing 30.

There are air outlet means 58 and 62 at opposite sides, respectively, of the housing 30. The housing 30 has a front wall 64 which wraps around the side of the housing and defines the opposite side walls 66, 76. As shown in FIG. 9, the side wall 66 has the narrowed, indented section 68, the outwardly turned section 72 and then the widened section 74. The unusual recess at 69 is to accommodate a projection from the vacuum cleaner motor 120, which is a portion of the motor intended to be installed in the housing 30. The opposite side wall 76 of the housing 30 has the correspondingly narrowed section 78, the outwardly turned section 82 and the widened section 84 thereof.

Referring to the outlet means 58, the above described shelf 42 at the top of the housing 30 continues around past the side 66 of the housing, and particularly past the widened portion 74 and the narrowed portion 68 thereof.

With reference to FIG. 11, at the narrowed section 68 of the side 66, the side 66 does not extend all the way up to the top shelf 42, but instead has a top end 86 thereof which is substantially beneath the top shelf 42. This defines the outlet space 88 through which cooling air may exit from housing 30. The outlet opening 88 is positioned at the top of the housing 30 so as to block undesired entrance therethrough of particulate material or liquid that might be splashed or thrown up under the vacuum cleaner.

Depending beneath the top shelf 42 is the downwardly extending protective wall 92, whose bottom end 94 is considerably below the bottom of the opening 88 at the top 86 of the wall section 68. In addition, the wall 92 extends to and terminates at one end thereof at the front wall 64 of the housing 30 and at the other end thereof at the outwardly turned wall section 72 of the housing. Because of the presence of the protective wall 92 and the closed sections at 64, 72 thereof, the outlet 88 for cooling air is protected against entrance of fingers, debris, etc. Cooling air simply exits through the outlet 96. As will become apparent further below, the bottom of the vacuum cleaner is not sealed, whereby the air escaping from outlet 96 is simply blown beneath the vacuum cleaner and easily exits to the atmosphere.

Spaced between the housing wall section 68 and the outer protective wall 92 is a single rib or grille element 98 which is supported at its ends at the walls 64, 72 of the housing. The rib 98 blocks entrance of a user's fingers or debris into the housing.

Figures 7, 8:
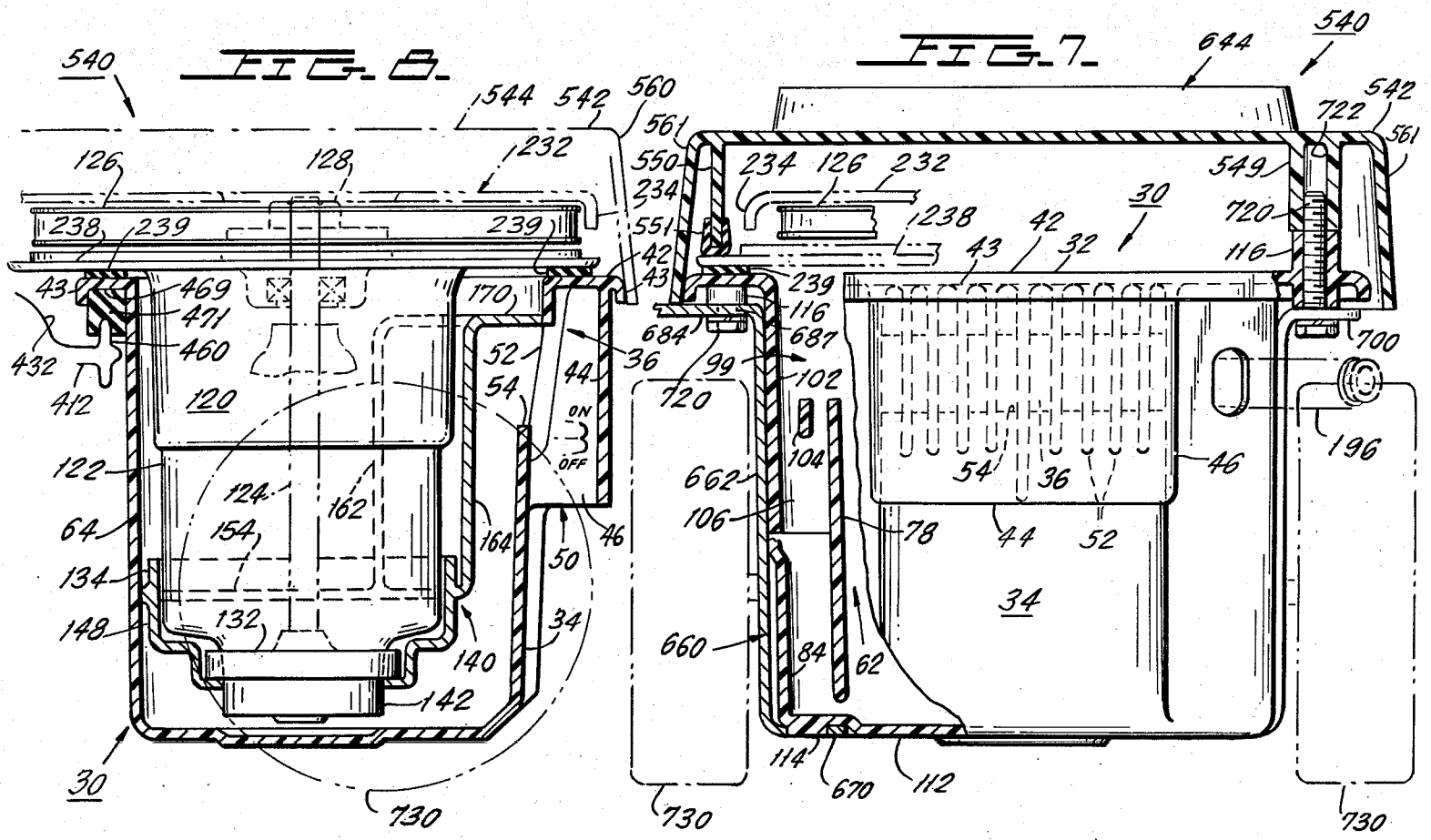
FIG. 7 is a rear view of the vacuum cleaner, also showing part of the vacuum cleaner in cross-section.
FIG. 8 is a side view in cross-section of the blower fan motor housing at the rear of the vacuum cleaner.

As shown in FIGS. 7 and 9, the cooling air outlet means 62 at the other side of the housing 30 is similarly configured to the outlet means 58. It has the outlet opening 99 above the top of the wall section 78. The outlet opening 99 is protected by the depending protective wall 102 and by the rib 104. The outlet of cooling air is through the cooling air outlet 106.

Placement of the cooling air inlet 46 at the rear of the housing 30 and placement of the cooling air outlet means 58, 62 on the sides of the housing is to minimize space, making the entire vacuum cleaner as compact a unit as possible.

There are molded to the bottom 112 of the housing 34 spaced apart bosses 114 which cooperate, as described below, with the brackets 660, 700 on the opposite sides of the vacuum cleaner so as to position the housing 30 with respect to the brackets and for attaching the housing 30 to the cover 540 over the vacuum cleaner.

There are four upstanding bosses 116 atop the shelf 42, two at the front corners of the housing and two that are rearward of the front wall 64 and forward of the chamfered sections 117, 119 of the housing side walls 66, 76, respectively. The bosses 116 are each in the form of a hollow sleeve which can have a bolt 720 passed through it (FIG. 7). The bosses 116 cooperate with bosses 546 below the cover 540 of the housing (FIGS. 5, 7 and 50) for establishing the depth of the space in the housing 30 in which the main blower fan 126 of the vacuum cleaner is located.

With reference to FIG. 8, the motor 120 inside the housing 30 is a conventional, by-pass flow, blow motor for a vacuum cleaner, wherein there is a main airflow for suctioning material into the vacuum cleaner tank and a secondary cooling airflow for cooling the motor, and wherein it is intended that there be separate airflows. Examples of by-pass type motors in vacuum cleaners are well known in the prior art and are not, therefore, specified here.

The blower motor includes an enclosure casing 122 with an AC electric motor (not shown) in it. The motor drives a shaft 124. At the top of the drive shaft 124, the conventional blower motor centrifugal fan 126 is secured by the nut 128. On the lower end of the shaft 124, the conventional, axial flow, by-pass air flow, motor cooling fan 132 is attached. The fans 126 and 132 rotate together. The flow path for air passing through the centrifugal fan 126 and the means by which the flow through the fan 126 is separated from the cooling air flow through the housing 30 are described below. The following description covers the cooling air flow through the motor housing 30.

Inside the housing 30, it is necessary to separate the cooling air flowing to the inlet (bottom) side of the fan 132 from the outlet flow of air that has been blown through the motor casing 122 and over the motor.

For this purpose, the baffle 140 shown in FIGS. 8, 12, 13 and 14 is now discussed. The baffle 140 includes the end bell 142 for the casing 122. The end bell 142 includes the bracket 144 which is integral with the end bell 142. The fan 132 is inside the narrowed lower portion 146 of the end bell 142.

Instead of the bracket 144 being included in the end bell 142, the end bell construction itself might be modified so that the shaft 124 of the motor is directly supported in a replacement for the end bell 142, 144 which functions substantially in the same manner. As shown when FIGS. 9 and 13 are combined, the entire baffle 140 will sealingly separate the housing 30 into two chambers on the two sides of the baffle assembly 140.

The passage of cooling air through the motor housing 30 comprises entrance of the air through opening 46, 36 and against the right side in FIGS. 12 and 13 of the upstanding wall 164 of the baffle 140, down past the wall 164, the upper section 148 of the end bell and the end bell 142, in through the bottom of the end bell 142, up inside the end bell past the cooling fan 132, inside the upper section 148 of the end bell past the housing sealing plate 154 and then out through the top of the upper end bell section 148. In passing through the section 148, the air cools the armature and fields of the motor. Then the air fills the section of the housing 30 above the plate 154 and to the left at FIGS. 12 and 13 of the upstanding plate 164, 166, 168. The air then exits from the housing through the outlet means 58, 62.

With reference to FIGS. 12, 13 and 15, which illustrate a two-wire power cord arrangement, the electric connection to the motor 120 comprises the two wires 176, 178 which extend from the motor, rise out of the space to the left of the wall 164 of the baffle plate, toward the rear of the housing 30 substantially at one chamfered side 117 thereof, extend up to and over the top of the upper plate 170 and then pass down through ovular hole 182 in that plate. The wires are then connected to the terminal block that is comprised of the terminals 186, 188, to which lead wires are secured. With reference to FIG. 15, the wire 176 from the motor is connected to the terminal 186. The wire 178 for the motor, on the other hand, extends to the manually operable on-off switch 190 (FIGS. 14–17) of the vacuum cleaner. From the switch 190 there is the connection 192 to the terminal 188. The terminals 186, 188 are connected to the main lead cord 196, which is connected to an electric power supply. The terminals 186, 188 securely hold the main lead cord to the housing to prevent the cord from being ripped out of the vacuum cleaner. The vacuum cleaner may alternatively be powered by a three-wire power cord arrangement, which, with minor modifications to the illustrated unit, could be used by persons skilled in the art.

Because the wires 176, 178 pass through the plate 170 at the hole 182, all of the wire connections to the motor are in the inflowing cooling air including the connections to the switch 190. Furthermore, all of the the connections are at the rear of the housing 30 and, therefore, at the rear of the vacuum cleaner, giving a user easy access to the switch 190 and making the vacuum cleaner quite compact in construction.

Figures 14, 16, 17, 39:
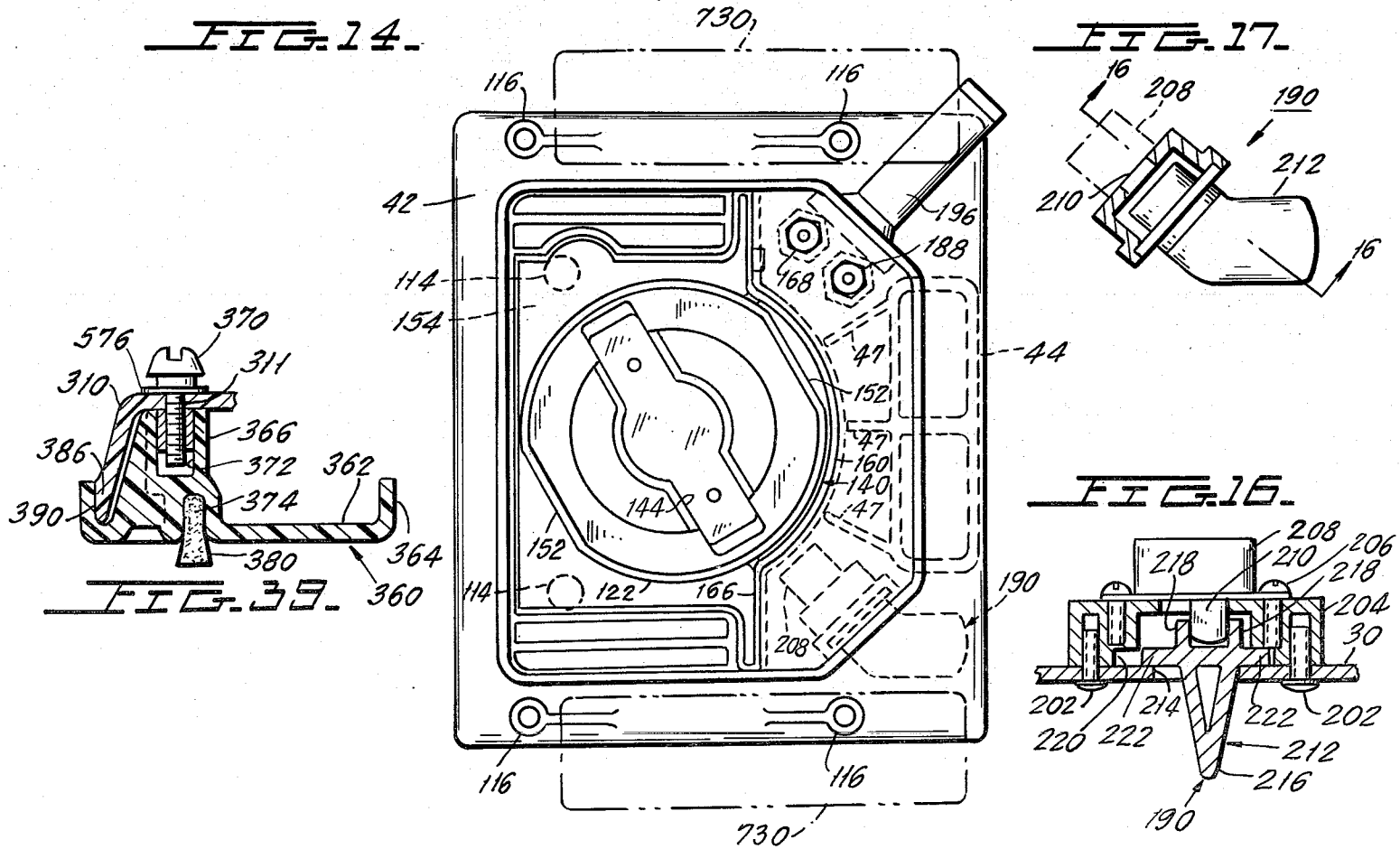
FIG. 14 is a top view of the motor housing shown in FIG. 9 with the baffle means of FIG. 13 installed.
FIG. 16 is a cross-sectional view of the manually operable switch means for operating the vacuum cleaner, along the lines 16—16 of FIG. 17.
FIG. 17 is a top plan view of the switch in FIG. 16.
FIG. 39 is a the same type of view as FIG. 37 showing the interconnection between the floor nozzle and the front portion of the tank of the vacuum cleaner.

As shown in FIGS. 14 and 15, the main lead cord 196 to the vacuum cleaner is located at the rear of the housing and at the chamfered side wall 117 thereof, whereby the wire 196 does not increase either the length or the width dimension of the vacuum cleaner, making it a compact unit. Furthermore, as will be apparent below, the housing is intended to be tipped back when the tank 300 is intended to be removed, and the placement of the wire 196 will assure that the wire does not interfere with tipping of the housing.

As can be seen from FIG. 14, the switch 190 is placed at the other chamfered rear side wall 119 of the housing. Its placement there assures that the switch does not increase the length or width dimension of the vacuum cleaner. Furthermore, its placement at the rear of the vacuum cleaner helps the user have access to the switch.

Both the main lead wire 196 (FIG. 7) and the switch 190 (FIG. 4) are located high up on the housing 30 so that if the vacuum cleaner passes through a pool of water or if water is splashed up, the electrical elements will be protected against being wetted. The electrical apparatus will thereby be protected from being splashed. The same comments applies to the elevated height of the inlet and outlet for the cooling air flow to the housing, as discussed above.

With reference to FIGS. 14, 16 and 17, the electrical switch 190 has a splash-proof mounting. The switch 190 is mounted to the side wall of the housing 30 by the fastening elements 202 which hold the bracket 204, and the bracket 204 receives the fastening elements 206 to hold the switch mechanism 208 of the switch 190 to the housing 30. The switch mechanism 208 is operated by conventional projecting slide operator 210 which can be slid to the left and right in FIG. 16.

There is a plastic batt 212 which is slidable along the slot 214 formed in the housing wall 30 for defining the terminal positions of the batt 212. The batt includes the manually operable switch arm 216 and the inwardly projecting fingers 218 that engage the switch slide 210. The bracket 204 is shaped to define a guide slot 220 for the batt, and the batt includes side guide arms 222 which are guided in the slot 220 for guiding the reciprocating movement of the batt 212. The side arms 222 also block against water, debris or the like splashing on to the switch 208, which, in effect, additionally insulates that switch.

Airflow to the main blower fan 126 is along a duct from the tank 300 and beneath the main cover 540. With reference to FIGS. 5, 6, 18–22, the airflow pathway from the tank is past the combined mounting plate and main blower fan cover assembly 230. With reference to FIGS. 4, 6, 8, 18 and 19, the relatively shallow depth cover 232 is permanently placed over the top of the main blower fan 126. The cover 232 has an annular peripheral side wall 234 that extends down to partially cover the periphery of the blower fan, but that leaves the lower part of the fan exposed for centrifugal expulsion of air. The cover 232 performs the function of a conventional cover over the top of the centrifugal fan in a blower motor. The cover 232 is above the fan 126, and the bottom of the side wall 234 is spaced above the top of the main blower fan housing cover 238, which is beneath the fan 126 to get a proper centrifugal flow of air from the fan 126. The blower fan housing cover 238 is part of the casing 122 for the motor 120.

A gasket 239 (FIGS. 6–8) sits atop the shelf 42 of the motor housing 30 and completely surrounds the motor. The cover 238 of the motor casing, in turn, rests on the gasket 239. Air leakage out of the casing is blocked by this gasket and the cooling air to the motor casing can enter and exit the casing only through the above described inlet 239 and outlet means 58, 62. Thus, the gasket 239 also prevents mixing of the cooling air for the motor with the air passing into and out of the main blower fan 126. In addition, the gasket 239 is of flexible material and is thick enough to yield slightly, whereby the vibration of the motor and the casing 122, which causes vibration of the plate 238, which is part of the motor and casing, is absorbed by the gasket 239 before it is transmitted to the housing 30, thereby greatly reducing motor noise.

At its center the cover 232 has an opening 240 through it, which is the main air inlet opening to the center of the centrifugal fan 126.

Figure 19:
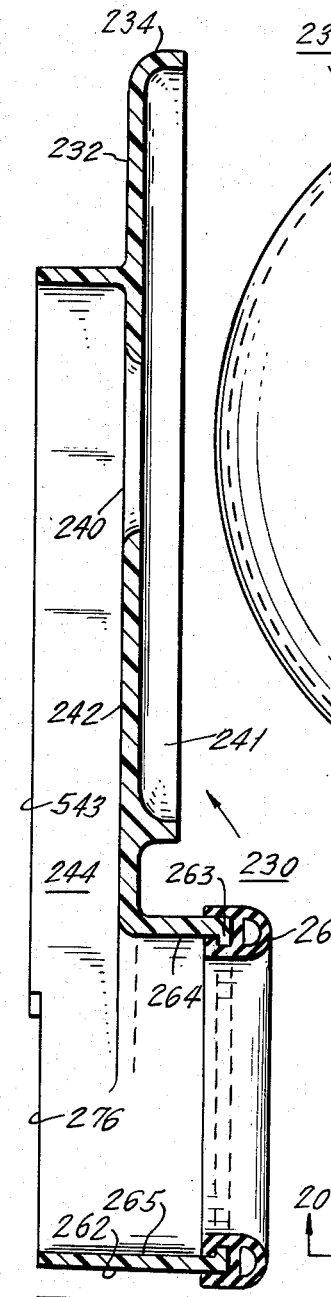
FIG. 19 is a cross-sectional view of the duct along the line 19—19 of FIG. 18.
Figure 20:
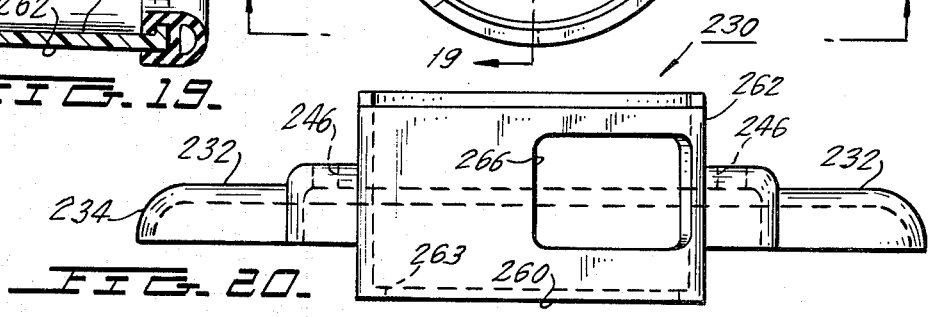
FIG. 20 is an end view of the plate and duct shown in FIG. 18 in the direction of arrows 20 in FIG. 18.

As shown in FIG. 19, the cover 232 is positioned above the open area 242 that is defined within the enclosure defined at the underside of the cover 232 and the area surrounded by annular wall 234 and air is expelled by the fan 126 into the open area 241. The cover 232 keeps the inflowing air to the centrifugal fan, which passes down through the opening 240, separated from the air that exits through the open area 241. The opening 241 simply opens into the large volume under the cover 540, and exiting air gently blows up and out through the cover 540, as described below.

A flat flange 242 extends away from the cover 232 toward the front of the vacuum cleaner. The flange 242 supports the upstanding, generally oval side wall 244 which extends up to the underside of the below described cover 540. The cover 540 closes off the top of the air duct, the side wall 244 closes off the sides of the duct and the cover 232 and flange 242 close off the bottom of the duct. The side wall 244 extends rearwardly to wrap around the opening 240 and extends forwardly to wrap around the aperture 260.

At the opposite sides of the duct 242, 244, in the cover 232 near the opening 240, respective bosses 245, having screw receiving openings therethrough, are defined for cooperating with respective depending bosses 547 under outer cover 540, as described below with reference to FIG. 50. Further forward along side walls 244, respective projecting lugs 246, with bosses having screw receiving openings therethrough, are provided. These, too, cooperate with respective depending bosses 548 under outer cover 540, as described below with reference to FIG. 50. The bosses 547, 548 under the cover 540 are of a length such that the peripheral wall 234 of the cover 232 provides the desired clearance above cover 238 for outlet from fan 126.

A relatively large diameter aperture 260 is defined in the flange 242 for inlet of air from the tank 300 into the duct leading to the blower fan 126. The diameter of the hole 260 is greater than that of the hole 240 in the cover 232. This reduces the velocity of air through the hole 260 and also in the duct communicating between the holes 260 and 240.

Figure 18:
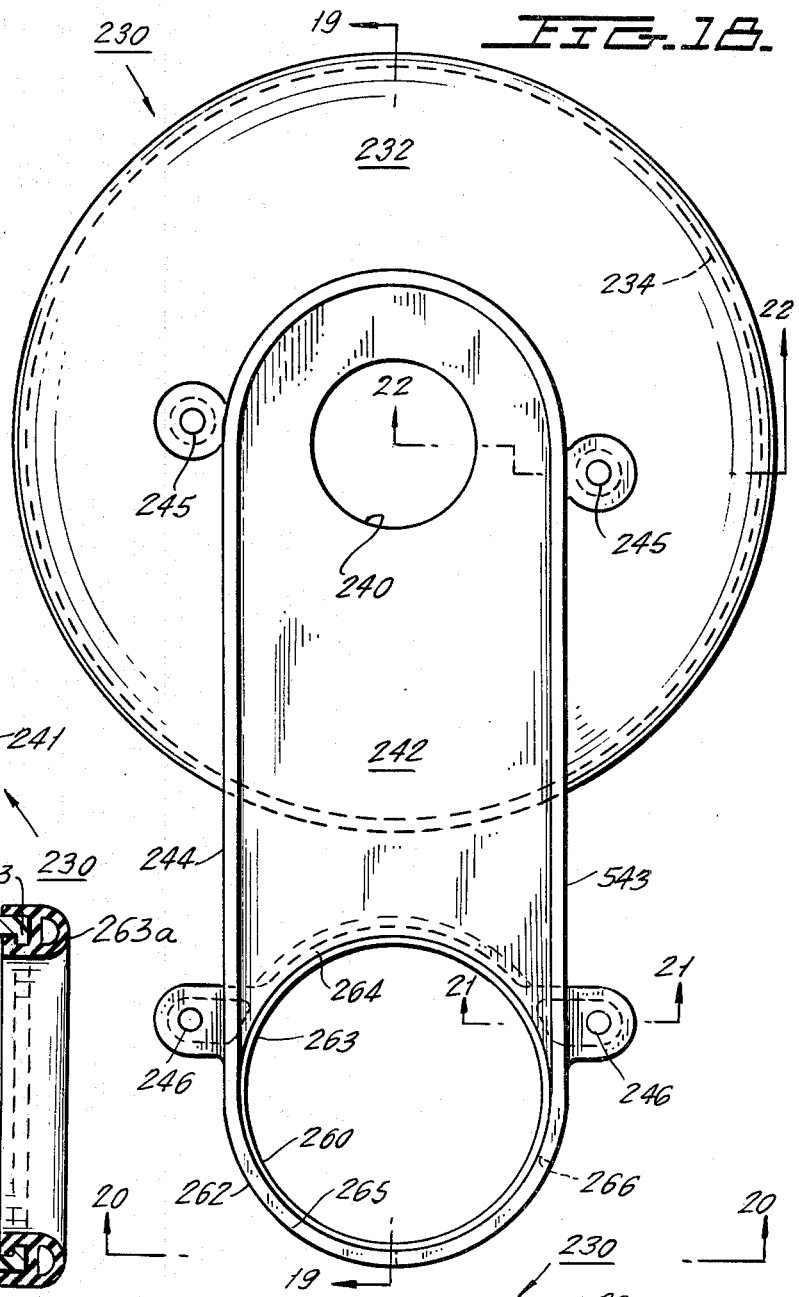
FIG. 18 is a top plan view of the mounting plate and the duct for connecting the tank and blower fan of the vacuum cleaner.

With reference to FIGS. 18 and 19, the inlet hole 260 is defined by an annular sleeve 262 that extends downwardly below the flange 242. The sleeve includes an inward lip 263 at its bottom for receiving a resilient, gasket 263*a* (see FIGS. 1 and 19) which provides a yieldable connection between the inlet hole 260 and the hole 420 in the cover 410 of the tank 300. Thus, misalignments between the sleeve 262 and the hole 420 are absorbed, without loss of seal.

The sleeve includes a portion 264 that is at the rearward side of the sleeve between the side walls 244, and the portion 264 extends down from the flange 242 to the step 263. Thus, portion 264 does not block air flow between holes 260 and 240. The portion 264 of the sleeve 262 merges into the portion 265 of that sleeve, which is also part of side wall 244 and extends down to step 263.

In portion 265, there is a window 266, which communicates externally of the sleeve portion 265 and into the space beneath the cover 540. When the window is open, air is drawn into the window and into the duct. As the fan 126 has a predetermined flow capacity dependent upon its structure and operating characteristics, with window 266 open, the volume of air drawn into the duct through opening 260 and out of the tank 300 is reduced, thus reducing the suction force at the nozzle of the vacuum cleaner. As window 266 is increasingly closed, reducing the volume of air drawn in from under the cover 540, the suction force through opening 260 and thus the suction force at the nozzle correspondingly increases.

There should be a constant rate of air flow through the main blower fan 126, dependent upon the construction of the fan, its speed and other operating characteristics. This assures that the fan motor will not be stressed to a variable extent and will not be overstressed. On the other hand, it is desirable to be able to vary the suction force at the vacuum cleaner suction inlet for different situations. The vacuum cleaner suction power regulator 270 shown in FIGS. 5, 23–28 divides the air flow through the inlet 240 to the main blow motor fan 126 between air drawn through the vacuum cleaner tank 300 and ambient air drawn through the window 266 from the large open volume beneath the cover 540.

The power regulator 270 comprises a disc 272 having a diameter larger than the diameter of the sleeve 262. The disc has an undercut, annular peripheral margin 274 which seats atop the portion 276 of the side wall 244 of the duct. The top of the side wall 244 at section 276 thereof is slightly lower than the height of the remainder of the side wall for accommodating the height of the disc margin 274. When the cover 540 is closed (see FIGS. 5 and 28), the disc 272 is beneath the cover, and the disc closes access into the duct through the cover 540, since the disc diameter is larger than the diameter of the opening 634 through the top of the cover. Through the opening 634, access to the disc 272 is obtained.

Along one angular segment thereof, the underside of the disc 272 at the margin 274 supports a downwardly depending, arcuately curved flange 278 which, as shown in FIG. 27, extends down around the outside of the sleeve section 265. The flange 278 has an angular length at least as great as the angular length of the window 266 so that at one rotative orientation of the disc 272, the flange 278 can completely cover the window 266. The window 266 occupies less than one quadrant of the entire annular sleeve 262 and the inlet may be selectively increased or reduced by rotation of the disc 272, the reduced volume of air passing from the tank 300 into the fan inlet 240 is compensated for by an increasing quantity of ambient air passing into the fan inlet.

As noted above, inlet to the centrifugal fan is from the outlet 260 which communicates into the outlet from the tank to the fan inlet.

The tank 300 from which air enters the duct can be seen in FIGS. 1–6, 29–33. The tank 300 includes a bottom wall 302, a front wall 303, a rear wall 304 and opposite side walls 305, 306. At its top, the tank is closed by the below described tank cover 410. The tank is a generally rectangularly shaped box.

Figures 30, 31, 46, 47:
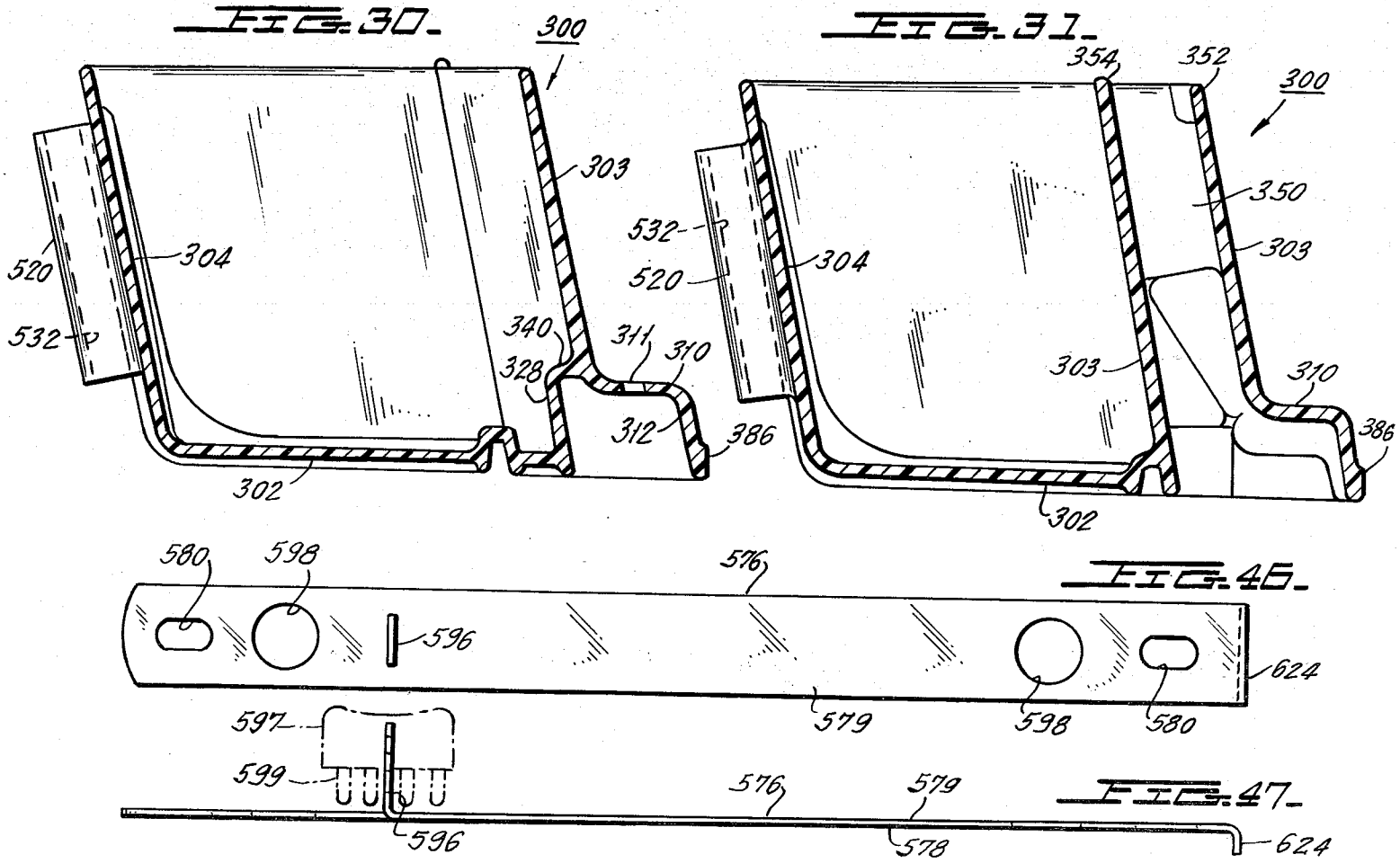
FIG. 30 is an elevational, cross-sectional view of the tank along the line 30—30 in FIG. 29.
FIG. 31 is also an elevational, cross-sectional view of the tank, along the line 31—31 in FIG. 29.
FIG. 46 is a top view of the latch plate attached to the cover of the vacuum cleaner and used for latching the cover to the tank of the vacuum cleaner.
FIG. 47 is a side view of the latch plate of FIG. 46.

Integrally molded to the front wall 304 of the tank is the inlet nozzle piece 310. The inlet nozzle 310 is located at the front of the vacuum cleaner, because that is where the major pickup of dirt is expected by the user of the vacuum cleaner. In addition, the nozzle 310 is short in height and also projects forward of the front wall 303 of the tank and forward of the entire vacuum cleaner, as shown in FIGS. 30 and 31 so that the front of the vacuum cleaner could be pushed under low furniture. The forward portion 310 of the tank has a pair of locating holes 311 in the top thereof for reception of a locator screw, described below.

Figure 33:
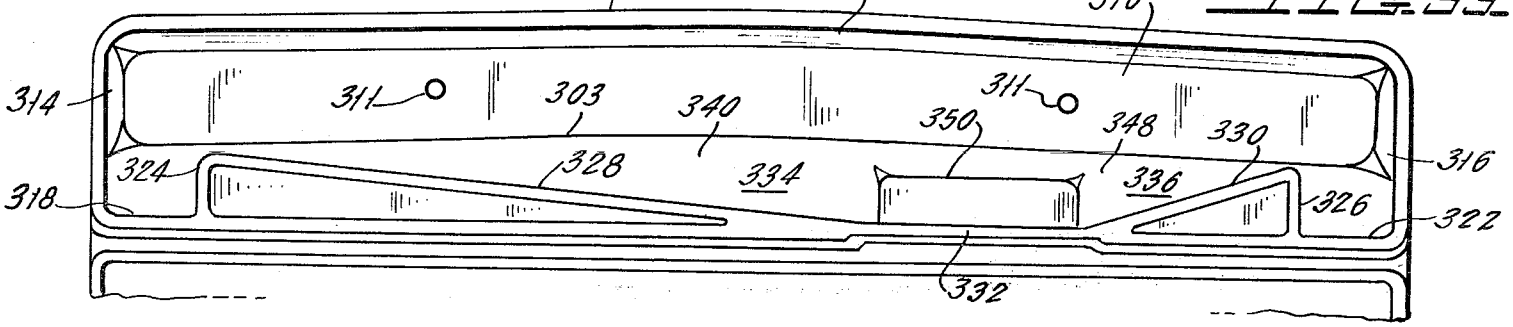
FIG. 33 is a bottom plan view of the front portion of the tank, i.e. a view of the tank from the opposite direction from FIG. 29.
Figures 34, 35, 36, 37, 38:
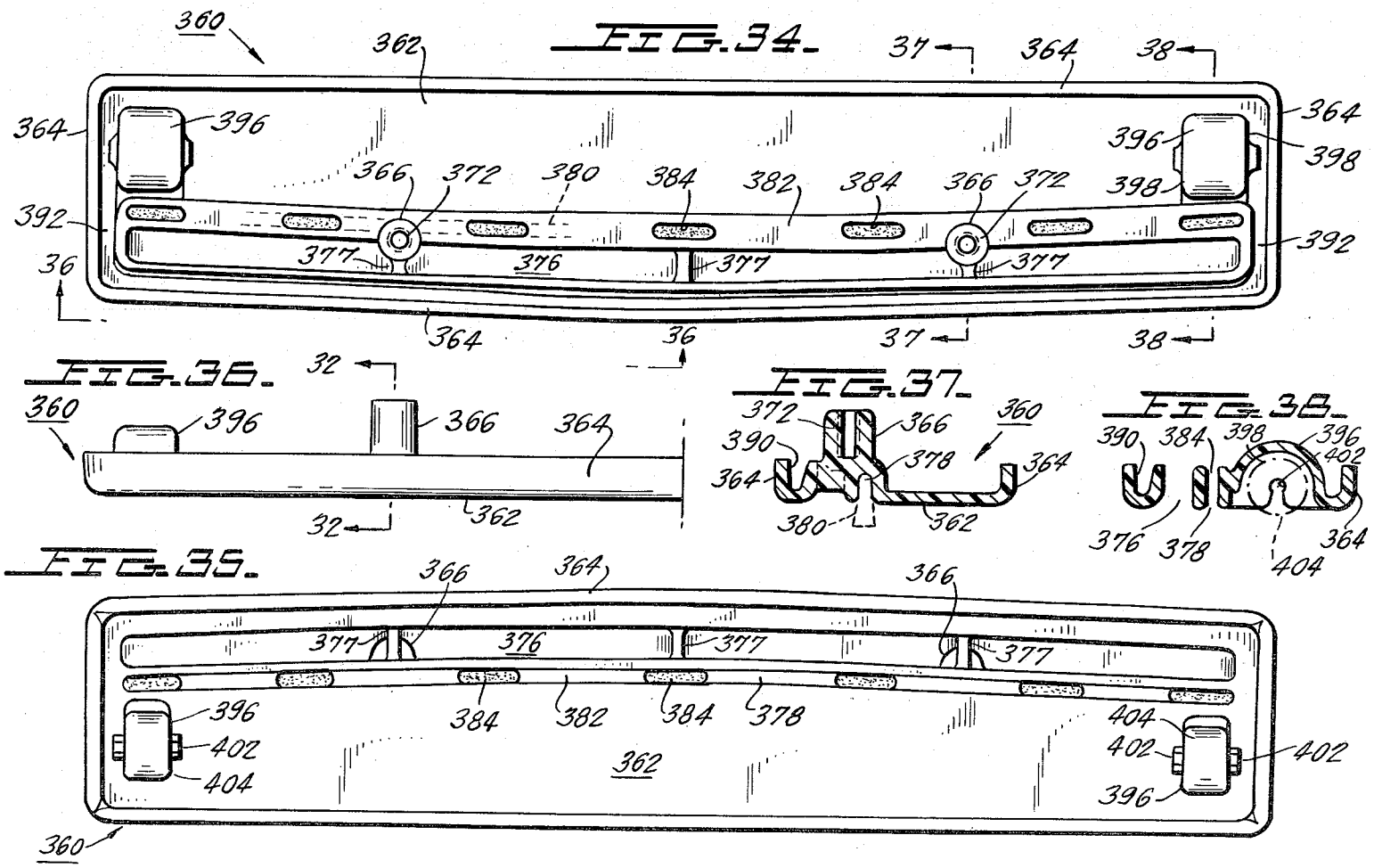
FIG. 34 is a top plan view of the floor nozzle which is positioned under the forward portion of the tank of the vacuum cleaner.
FIG. 35 is a bottom plan view of the floor nozzle.
FIG. 36 is a fragmentary, side elevational view of the floor nozzle of FIG. 34, along the line 36—36 in FIG. 34.
FIG. 37 is a cross-sectional view through the floor nozzle, along the line 37—37 of FIG. 34.
FIG. 38 is a cross-sectional view through the floor nozzle along the line 38—38 of FIG. 34.

With particular reference to FIG. 33, the suction inlet opening at the bottom of the tank and of the nozzle piece 310 is defined by the front section 312 of the suction inlet, the side wall sections 314, 316, the opposite, short length, rear wall sections 318, 322, the forwardly extending short walls 324, 326 which lead to the transition section, the rearwardly, gradually sloping walls 328, 330 which are inclined to the rear of the nozzle as they move toward each other and the section 332 where the inclined wall sections 328, 330 merge. The inclined wall sections 328, 330 respectively define the rear sides of the transition sections 334, 336 of the nozzle. The suction inlet opening is partially covered by a cover 360, described below.

The transition sections 334, 336 are to the rear of and above the inlet nozzle 310. The transition section 334 is defined on the rear side thereof by the wall 328, and on the front side thereof by the front wall 303 of the tank. The top of the transition section 334 is defined by the wall 340 which, as shown in FIG. 32, gradually inclines upwardly toward the central section 350.

Similarly, the transition section 336 is defined at its rear side by the wall 330, at its front side by the tank front wall 303 and at its top by the inclined wall 348, which also gradually inclines upwardly toward central section 350.

The transition sections 334, 336 merge up into the upstanding, central, rectangular cross-section, inlet section 350 at the front of the tank. The forward wall 352 of the central section of the inlet nozzle, which is at the front wall 303 of the tank extends into contact with the underside of the cover 410 of the tank. The rear wall of the central section extends up at 354 to a height at which it will be in a position to sealingly engage the inlet nozzle closing and opening inlet flow selection plate 446, also described below (FIG. 5), which is on the cover of the tank. As described below, this will enable the inlet nozzle 350 to be sealed closed or opened, depending upon whether the suction inlet is to be used or a separate hose inlet is to be used.

Figure 29:
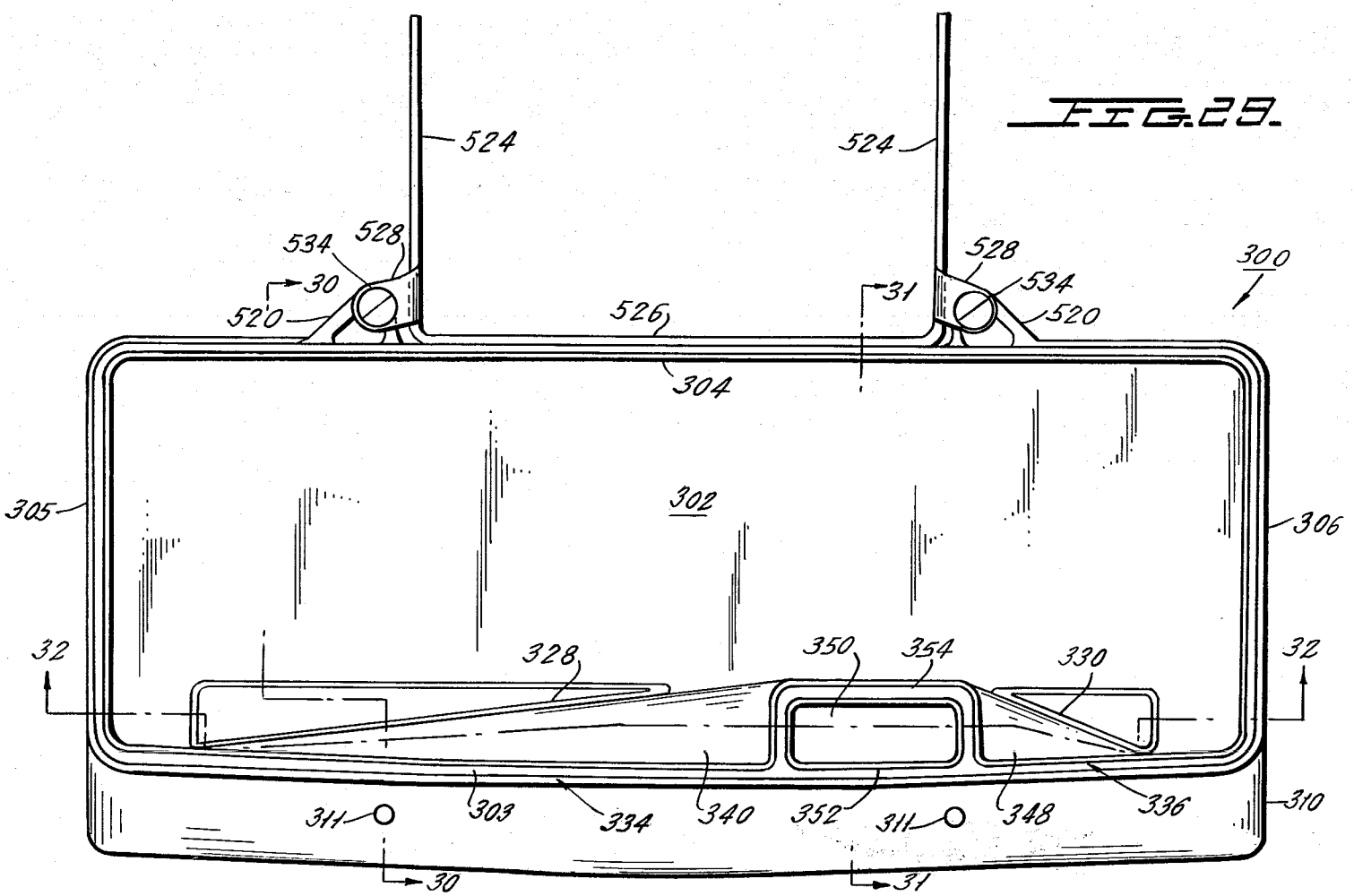
FIG. 29 is a top plan view of the materials collecting tank of the vacuum cleaner.
Figure 32:
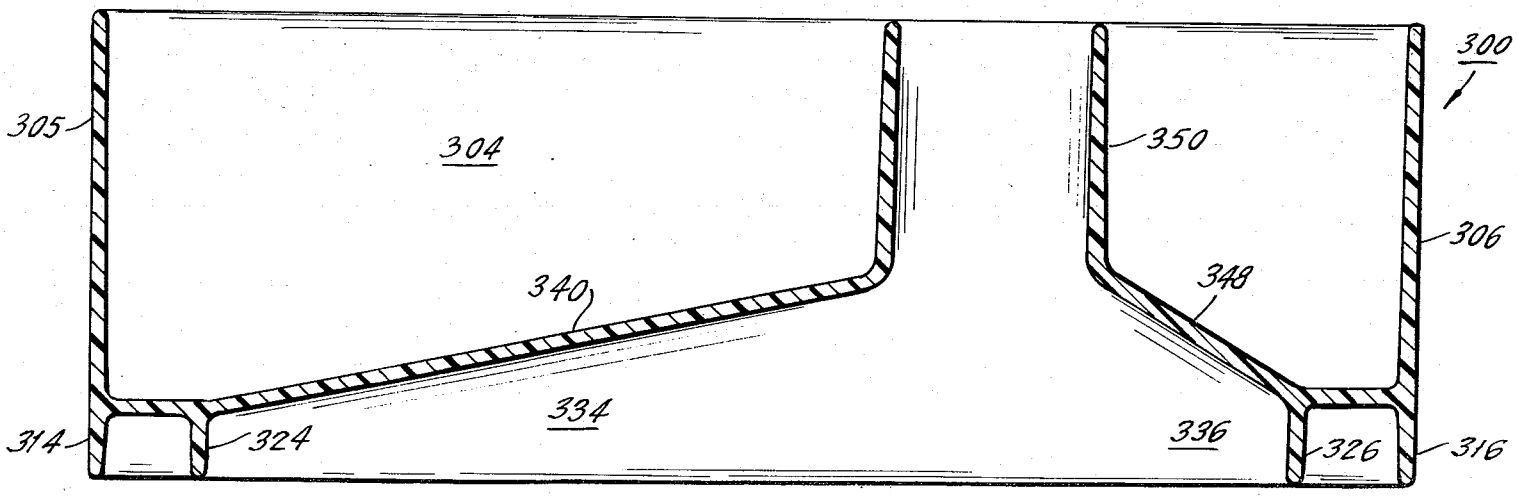
FIG. 32 is a front, elevational, cross-sectional view of the tank along the line 32—32 in FIG. 29.

As is apparent from FIGS. 29, 32 and 33, the transition sections 334, 336 become narrower in front to rear width and shorter in height moving outwardly toward the sides 305, 306 of the tank, and particularly moving outwardly away from the nozzle central section inlet 350. As is conventionally known in the vacuum suction field, narrowing the orifice further from the source of vacuum enables the velocity of incoming air to remain constant across the entire width of the inlet nozzle, instead of having the velocity drop off toward the side ends of the nozzle.

At the inlet section 310 of the tank, a floor nozzle 360 shown in FIGS. 34–39 is provided. The floor nozzle includes a plate 362, which is turned up around its entire peripheral edge, defining edge flange 364. Generally toward the front of the plate 362, and so that they will be positionable beneath the locating holes 311 in the front portion 310 of the tank, the floor plate 362 has a pair of upstanding bosses 366, by which the floor plate 362 is affixed to the front portion 310 of the nozzle. As shown in FIG. 39, a fastening screw 370, discussed in further detail below, is passed through the hole 311 in the nozzle front portion 310 and is then threadably connected into the opening 372 in each boss 366. The screw 370 also serves as part of the means for latching the cover 540 in place over the tank 300, as described further below.

The underside of the floor plate 362 is essentially a closed, flat plate. There is a narrow width inlet slot 376 which extends through the floor plate across the entire width of the floor plate 362 near the forward side thereof and when the floor plate 362 is disposed beneath the nozzle, the slot 376 is under the forward portion 310 of the inlet nozzle and is also in front of and in direct communication with the inlet nozzle 334, 336, 350 to the tank 300. The slot 376 is spanned by a plurality of ribs 377.

Immediately to the rear of the inlet opening 376 in the floor plate 362, the floor plate is folded to define a slot 378 that extends across the floor plate 362 over the full width of the inlet opening 376 therein. The slot 378 receives the floor brush 380, which extends the full length of the slots 378. The floor brush 380 is comprised of a short height strip of a pressed fibrous fabric material of a thickness such that it is gripped by the front and rear walls of the slot 378 and of a height such that it reaches to the top of the slot 378 and extends beneath the underside of the floor plate 362 to contact the floor or surface being vacuum cleaned. The material of which the brush 380 is comprised is a proprietary material. The material has the characteristic that on a dry floor or surface, the brush pushes vacuumable material to the inlet slot 376 to be sucked in. On a wet floor or surface, the floor brush material picks up and moves water or liquid beneath the plate 362 so as to move it beneath the inlet slot 376 where the liquid can be suctioned up. Finally, on carpet, the brush 380 can serve as a carpet brush. In prior art vacuum cleaners, as each of these three different functions are to be performed, the brush adjacent the inlet slot must be changed. Here, it is contemplated that the brush 380 will be a permanent installation serving all three functions.

The folded top wall 382 of the plate 362, which defines the slot 378, has a plurality of through cuts 384 defined in it. Access to the brush 380 through the cuts 384 enables the brush to be glued into the slot 378.

The floor plate 362 should be fastened beneath the tank nozzle 310. To this end, as shown in FIG. 39, the downwardly depending front lip 386 of the front portion 310 of the nozzle is received in the slot 390. Since it is desirable for the filter to be as high off the bottom 302 of the tank as reasonably possible to keep the filter out of the water and to provide a large wet material capacity for the vacuum cleaner, the upraised well 414 provides this. The well 414 is topped by the top wall 416 thereof. The upraised well top wall 416 has a hole 420 passing through it which is aligned with the opening 260 through the bottom flange 242 defining the duct communicating to the main blower fan 126. The upraised annular rib 422 around the opening 420 is shaped so as to be received in the opening 260 to form a seal therewith. The above described gasket **263*a* holds the seal in the event of misalignment between the rib 422 and the bottom of the opening 260**.

Figure 4:
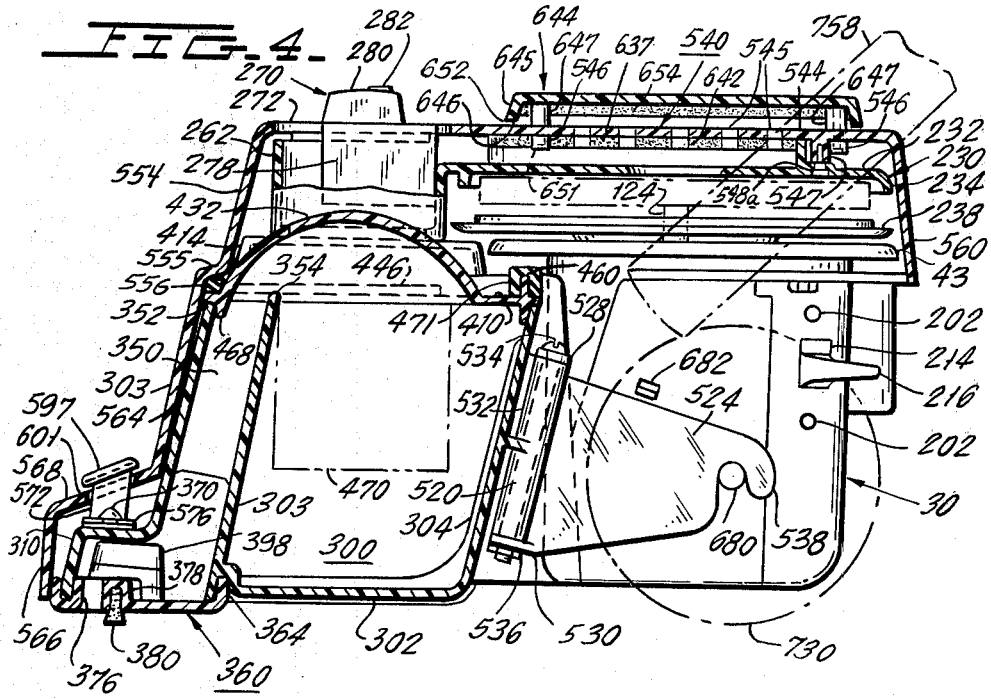
FIG. 4 is a side cross-sectional view through the vacuum cleaner in the cover closed condition.
Figure 3:
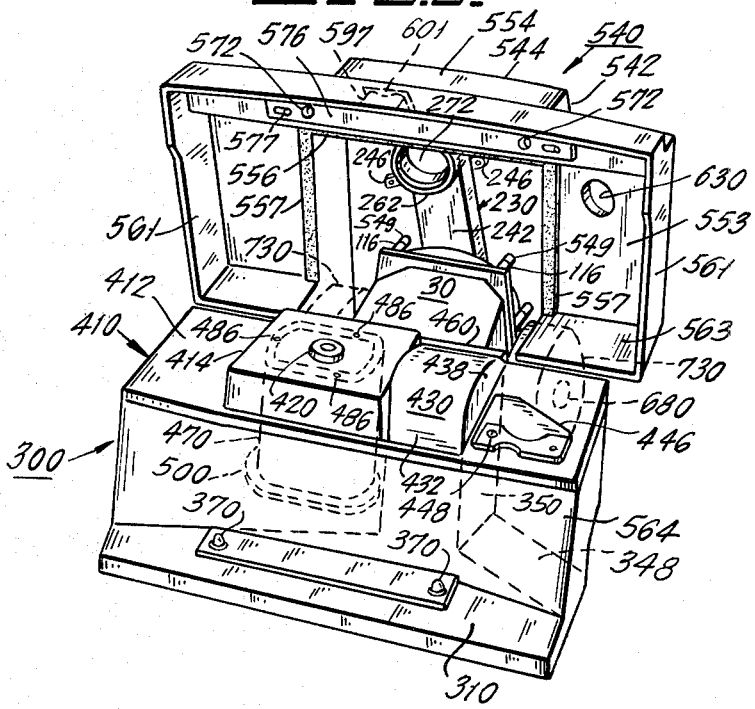
FIG. 3 is a front perspective view showing the vacuum cleaner in the cover open condition.
Figure 6:
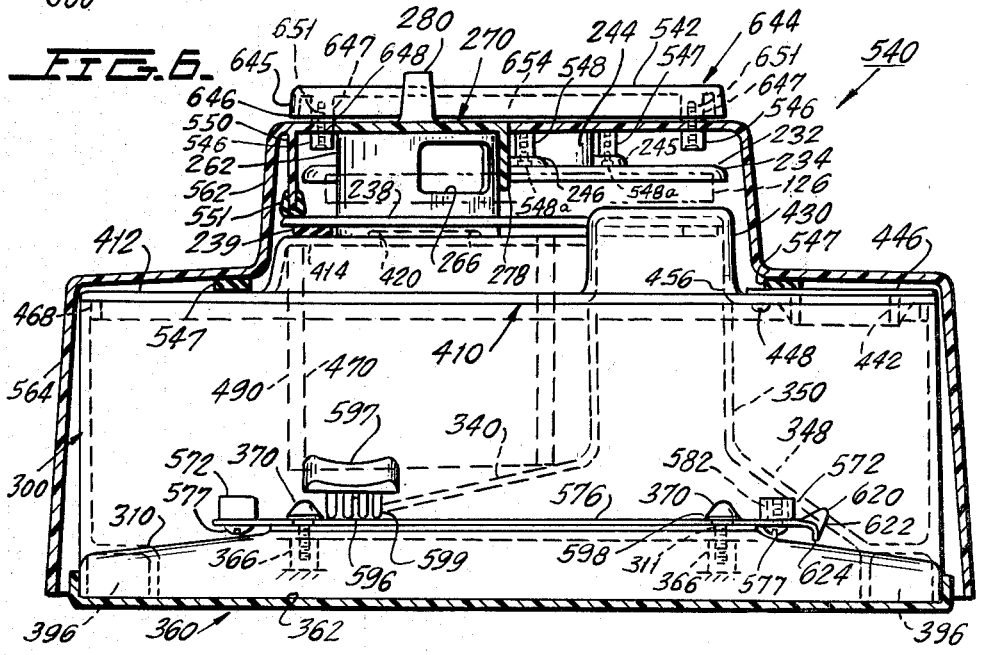
FIG. 6 is a front elevational view in cross-section of the vacuum cleaner.
Figure 40:
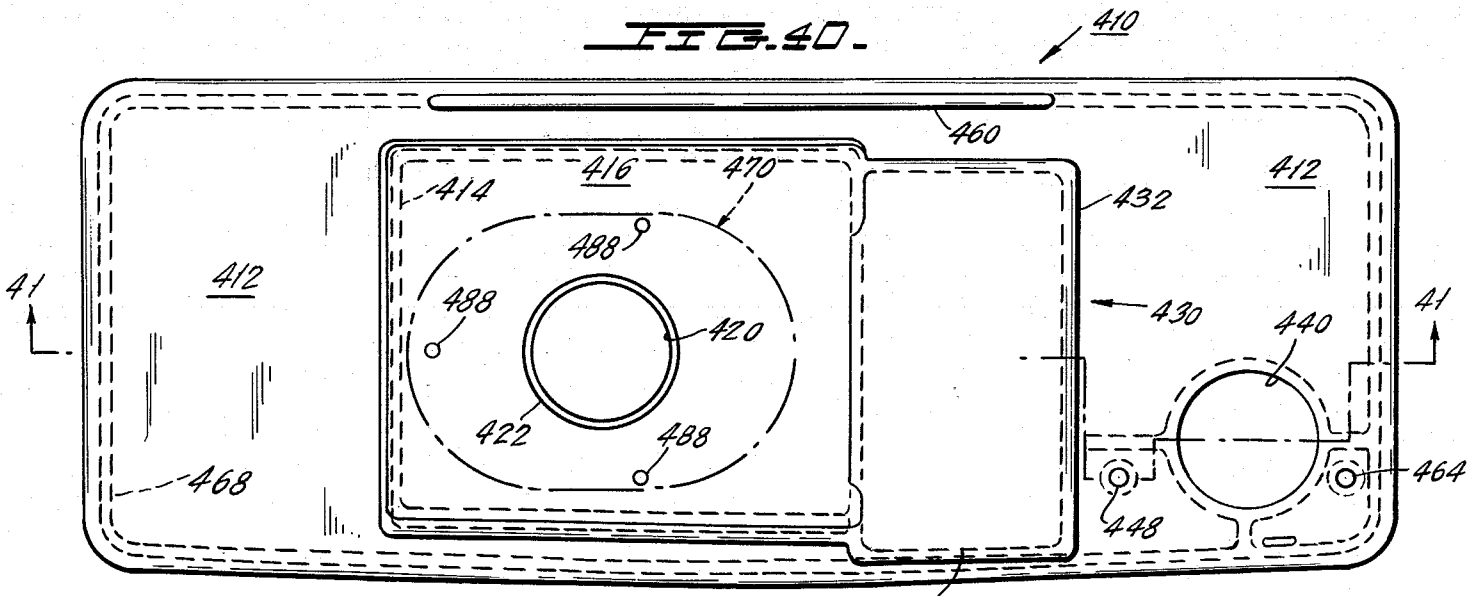
FIG. 40 is a top plan view of the cover for the tank of the vacuum cleaner.
Figure 41:
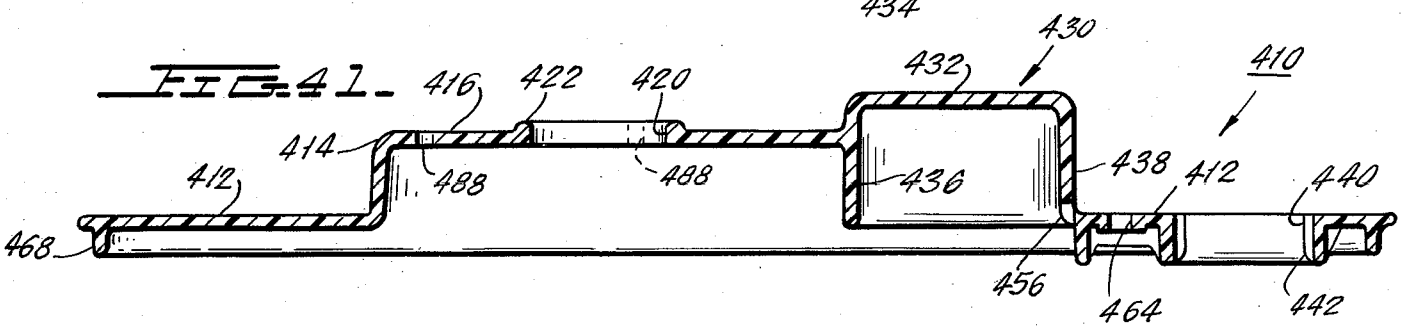
FIG. 41 is an elevational view in cross-section of the tank cover along the line 41—41 of FIG. 40.

Adjacent the upraised well 414 is a curvedly shaped flow redirector section 430 which is essentially comprised of the curved surface 432 formed in the top of the tank cover (FIGS. 4, 40 and 41). The section 430 of the tank cover is positioned over and has the same side-to-side width as the upper portion of the inlet nozzle section 350 and actually serves as an extension of that section (FIGS. 4 and 6). The entrance side 434 of the curved wall 432 is at the exit from the inlet nozzle section 350. The wall 432 redirects the air, liquid and debris flowing into the tank 300 through the nozzle. The curved shape of the wall 432 aids in separating water from the inflowing air as they both enter the tank. Because the water is heavier than the air, the water travels around the surface of the wall 432 and drops into the tank 300 in front of the rear wall 304 of the tank. The air flowing through the inlet 350 and under the covering wall 432 simply moves down past the dividing wall 436 which divides the redirector section 430 from the well 414 and passes into the air beneath the well 414 where the air is able to pass to the below described filter 490. Were the top wall 412 of the tank not curved at 432 and were the inlet 350 to the tank nearer to the outlet 420 from the tank and, thus nearer to the filter 490, the filter would be much sooner wetted by water drawn into the tank. In addition to the dividing side wall 436, whose function has been described, the section 430 has an opposite side wall 438 which is joined to the plate 412 to complete the section 430 of the tank cover 410.

The plate 412 also has a circular auxiliary hose inlet opening 440 which is defined by the annular depending sleeve 442 that surrounds the opening 440 and provides guidance and support for an inserted hose (not shown). Upon attachment of a hose (not shown) to the inlet opening 440, material can be drawn into the tank 300 through the opening 440.

Figure 5:
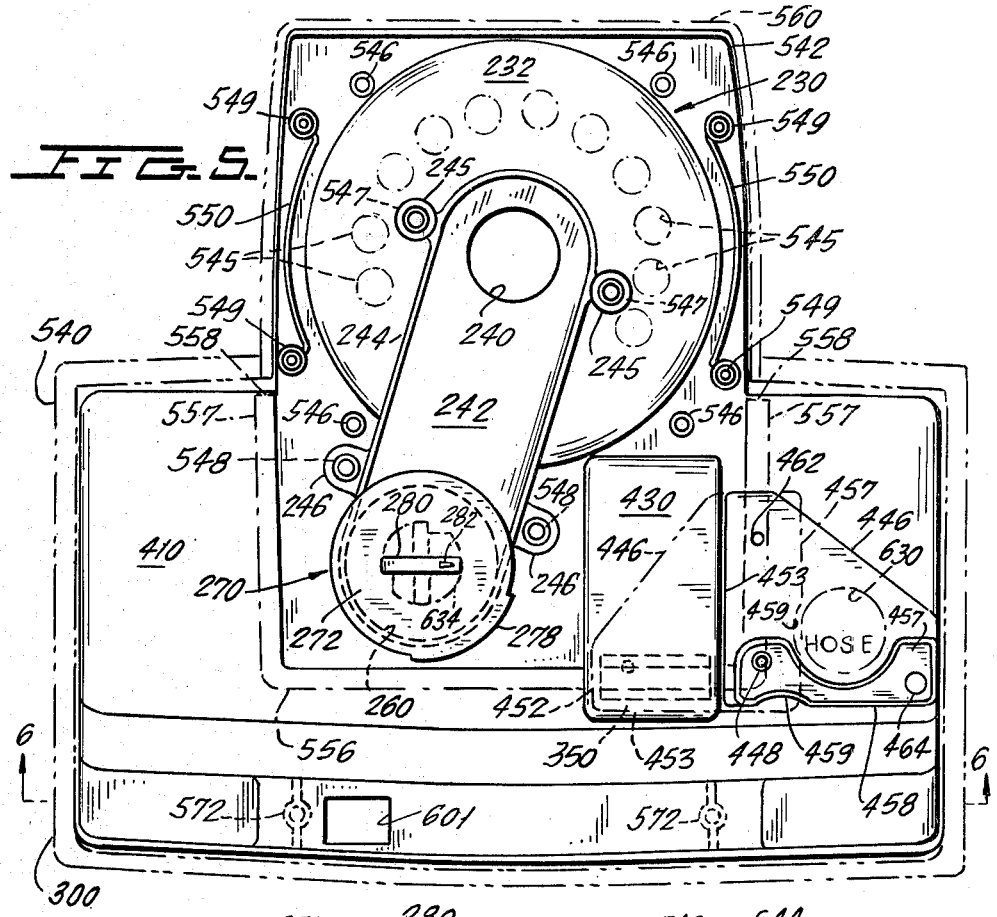
FIG. 5 is a top plan view of the vacuum cleaner, with the cover over the vacuum cleaner being invisible for enabling viewing of the vacuum cleaner as seen beneath the cover thereof.

With reference to FIGS. 5 and 6, a plate 446 is provided for selecting whether inflow to the tank 300 will be through the floor nozzle 334, 336, 350 or through the auxiliary hose opening 440. The generally flat and generally right triangularly profiled inlet selector plate 446 sits on top of the plate 412 of the tank cover and is therefore under the cover 540. The plate 446 is swivelable around pivot 448 on the plate 412 between its solid line position of FIG. 5, at which it seats over and blocks the auxiliary hose inlet opening 440 and its broken line position to the left where it blocks the inlet section 350 from the floor nozzle. The plate 446 includes the section 452 near the edge 453 thereof, which section is shaped to cover over the top of the inlet section 350. As shown in FIG. 4, the plate engages the top 354 of the rear wall of the opening of inlet section 350, and also extends forward to the top 352 of the front of the inlet section 350.

To facilitate the swiveling of the inlet selector plate 446 between its illustrated positions, the side wall 438 of the redirector section 430 of the tank has a slot 456 extending along its length of a height such that the plate 446 can pass through it, but which also enables the wall 438 to seal against the plate, blocking leakage.

An additional plate 457 is attached to edge 458 of the plate 446 and the plate 457 provides a more rigid part of the plate 446 to be manually operated for swiveling the plate 446 between its positions. The cutout 459 on edge 458 provides clearance for a hose to be installed in hole 440. Gaining access to the plate 446 requires that the cover 540 be lifted, as described below.

A detent hole 462 in the plate 446 cooperates with the detent pin 464 projecting up from the plate 412 so that the opening 462 can snap detent onto the pin 464 for holding the plate in its solid line position. No similar detent has been provided for the plate 446 at the other, broken line position, because a hose inserted in the opening 440 will prevent the plate 446 from returning to block the opening. The inlet selector plate 446 provides that inflow to the tank is either through the floor nozzle or through an auxiliary hose, but not through both.

The cover 410 is held in place on the tank by the clamping action of the bottom of the sleeve 262, 263, 263*a* (FIG. 19) around the inlet 260 pressing down upon the peripheral rib 422 around the opening 420 (FIG. 41) in the tank cover (FIG. 4). Furthermore, the peripheral flange 468 around the entire periphery of the cover 410 cooperates with the peripheral side walls of the tank on which it is seated. The partial vacuum created by suction force in the tank draws the side walls of the tank securely against the peripheral flange 468 of the tank cover.

Also serving to hold the cover 410 in place and, helping to define a noise seal is the rib 460 extending a short height up from and longitudinally along the rear portion of the cover 410. (See FIGS. 4, 8 and 40.)

At the front of the motor housing 30, between the flange 43 and the housing front wall 64, a notch 469 is defined. (See FIGS. 8, 9 and 10) Into that notch, a strip 471 of resilient foam rubber, of a thickness greater than the distance between flange 43 and wall 64, and depending beneath the bottom of flange 43 is installed over the length of the rib 460. (See FIG. 8.) The length of the strip is greater than that of the rib 460, since the strip 471 must extend to contact the legs 557 of the sealing element 556 along the lateral sides of the tank cover. One of the surfaces of the strip 471 carries an adhesive layer thereon by which the strip is secured in the notch 469. The strip 471 cooperates with the U-shaped air seal element 556, described below, for sealing against leakage of air exhausted from the main blower fan 126 down the inside of the cover 540. Also, the combined strip and seal element 471, 556 seal against transmission of noise to the outside of the vacuum cleaner. When the cover 540 is closed, this presses down on the motor housing, due to the connection between the cover and the motor housing, and the motor housing presses down upon the strip 471 and also resiliently deforms the strip over the rib 460. This helps hold down the tank cover 410 and also reduces noise transmission from the rigid and thus vibratable motor housing 30 to the correspondingly rigid and vibratable tank 300.

Air flow out of the tank 300 and through the tank outlet opening 420 to the main blower fan 126 is filtered to removed particulate matter.

A filter supporting cage 470 (FIGS. 3, 4, 6, 40, 42, 43 and 44) is installed inside the well 414 beneath the upper surface 416 thereof. The filter cage has a generally oval shape in horizontal cross section. The filter cage has an annular upper supporting rim 472 and an annular lower supporting rim 474. The rims give the generally oval shape to the filter cage 470. The top of the filter cage 470 is open, while the bottom rim 474 of the filter cage is connected with a bottom plate 475 which closes the bottom of the filter cage.

Figure 44:
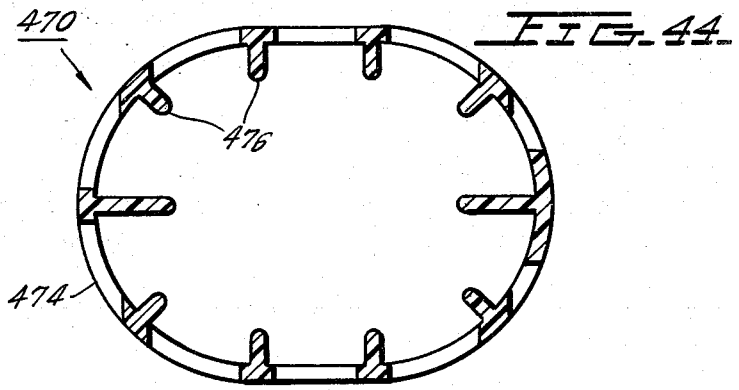
FIG. 44 is a cross-sectional view of the filter basket along the lines 44—44 in FIG. 42.
Figure 45:
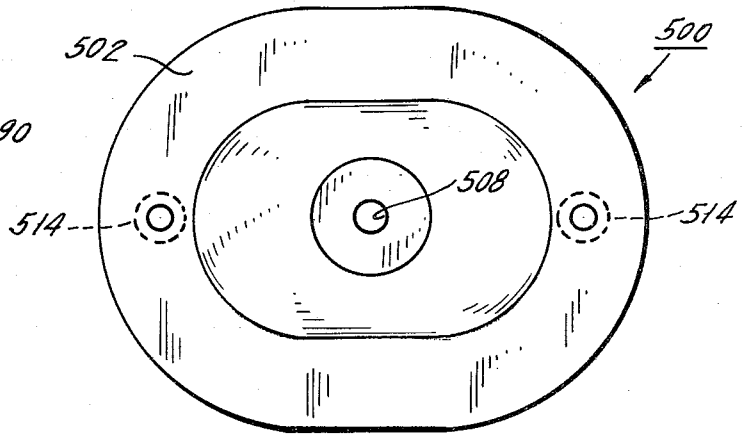
FIG. 45 is a view along the line 45—45 in FIG. 42 showing the bottom cover of the filter basket in plan view.
Figure 43:
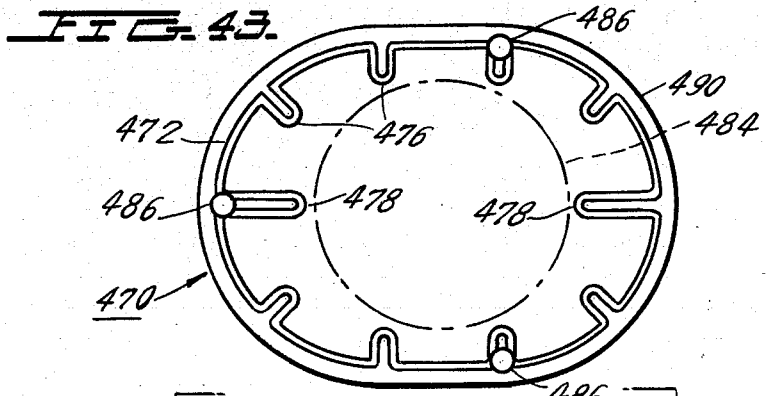
FIG. 43 is a top view, in the direction of the arrows 43—43 in FIG. 42, of the filter basket shown in FIG. 42.

A series of axially extending ribs 476, 478 extend between and are supported by the upper and lower rims 472, 474. As seen in FIGS. 43 and 44, the ribs have different radial lengths with the ribs 478 at the narrow ends of the cage having greater radial length. Between adjacent ribs 476, 478 there are large openings 480, through which the suctioned air may pass. As can be seen in FIGS. 4 and 6, the ribs 476, 478 give the filter cage 470 a height such that its lower end is above the bottom 302 of the tank.

Prior to installation of the filter cage 470 in the well 414, a floatable ball 484 is placed inside the cage. The ball normally rests at the bottom of the cage, but when the tank 300 in which the filter cage is positioned fills with liquid, the ball floats up in the cage 470 until it blocks the outlet opening 420 from the tank, thereby sealing the inlet to the blowing fan and its motor. The radial lengths of the ribs 476, 478 are selected so as to help confine the ball so that its motion is generally limited to vertical motion in the filter cage 470.

Projecting up from the top of the upper rim 472 of the filter cage 470 are three pins 486 which are shaped and positioned to be received in cooperating holes 488 in the top surface 416 of the well 414. This positions the filter cage immediately beneath the tank outlet opening 420. When the pins 486 project through the holes 488, they are simply heat staked to hold the filter cage permanently in position in the well.

Figure 42:
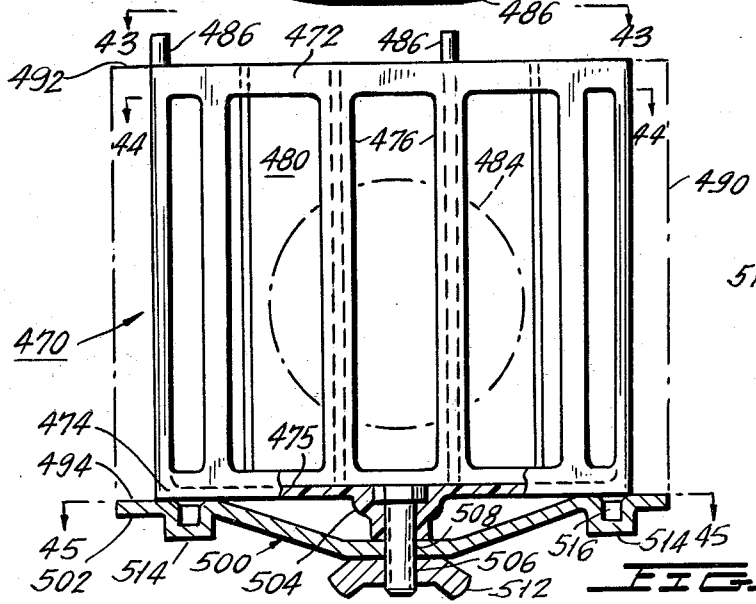
FIG. 42 is an elevational, cross-sectional view of the filter basket used for supporting the filter at the outlet from the tank of the vacuum cleaner.

With reference to FIGS. 42 and 43, an annular filter 490 is wrapped tightly around the exterior of the filter cage 470 and engages the external periphery of the ribs 476, 478. The filter is a simple annulus comprised of unwoven, fibrous material which is compressed into a filter. Filter wing nut 512 is tightened up on the screw 506 against the cover 500 to hold the cover in position against the nipple 504.

To assure the desired orientation of the lower cover 500 with respect to the filter cage 470, the cover has orientation boss receptacles 514 in it which receive cooperating bosses 516 projecting down from the underside of the bottom 475 of the filter cage.

All of the tank 300, the tank cover 410, the filter and filter cage 470, 490 the inlet nozzle to the tank 334, 336, 350 and the floor plate 360 are a single unit. (See FIG. 1.) It is contemplated that this entire single unit will be separable from the rest of the vacuum cleaner.

With reference to FIGS. 4 and 29, on the exterior of the rear wall 304 of the tank 300 a pair of bosses 520 are integrally formed at spaced apart locations. A bracket comprised of a pair of identical hooks 524 is supported on the bosses 520 and extends rearwardly of the tank 304. The hooks 524 are integrally connected through the connecting plate 526 between them. Fastening flanges 528, 530 at the top and bottom, respectively, of the hooks 524 extend over the top and bottom ends of the bosses 520. The bosses have respective openings 532 extending through them for receiving the respective bolts 534. The nuts 536 tightened on to the bolts 534 rigidly secure the hook bracket 524-530 to the bosses 520.

The hooks 524 include the respective hook portions 538 which hook over the respective axles 680, inboard of the main wheels 730 of the vacuum cleaner. The hooks 538 do not latch onto the axle 680 but are freely removable therefrom. However, the below described cover 540 over the vacuum cleaner and the tangs 682 hold the tank down in position and hold the hooks securely in position over the axles. The weight of the tank 300 is distributed between the axles 680 and the above described floor nozzle 360.

When the cover 540 is pivoted upwardly, as described below, access to the tank 300 is facilitated. The tank is not intended to swivel in the same manner as the cover 540. Once the cover is up, however, the tank 300, the elements attached thereto, as described above, and the hooks 524, 538 may be simply lifted up off the wheel axles. Upon removal of the cover 410 over the tank 300, the filter 490 is also removed from the tank. This gives access to the filter, in case it should be replaced or taken off for cleaning. The liquid and dirt in the tank can be simply dumped or washed out. Then the cleaned tank can be replaced and the cover 410 can be replaced over the tank.

There is a main cover 540 over the entire vacuum cleaner. (FIGS. 1–8, 50 and 57.) The cover includes the rectangularly shaped, most upraised top section 542, which includes the flat top wall 544 which is of such a height that its underside rests against the top surfaces 543 of the above described side walls 244 of the duct leading between the outlet 420, 260 of the tank and the inlet 240 to the blower fan 126. (See FIG. 4.) Thus, the top wall 544 of the cover closes the top of the duct 240.

Figure 50:
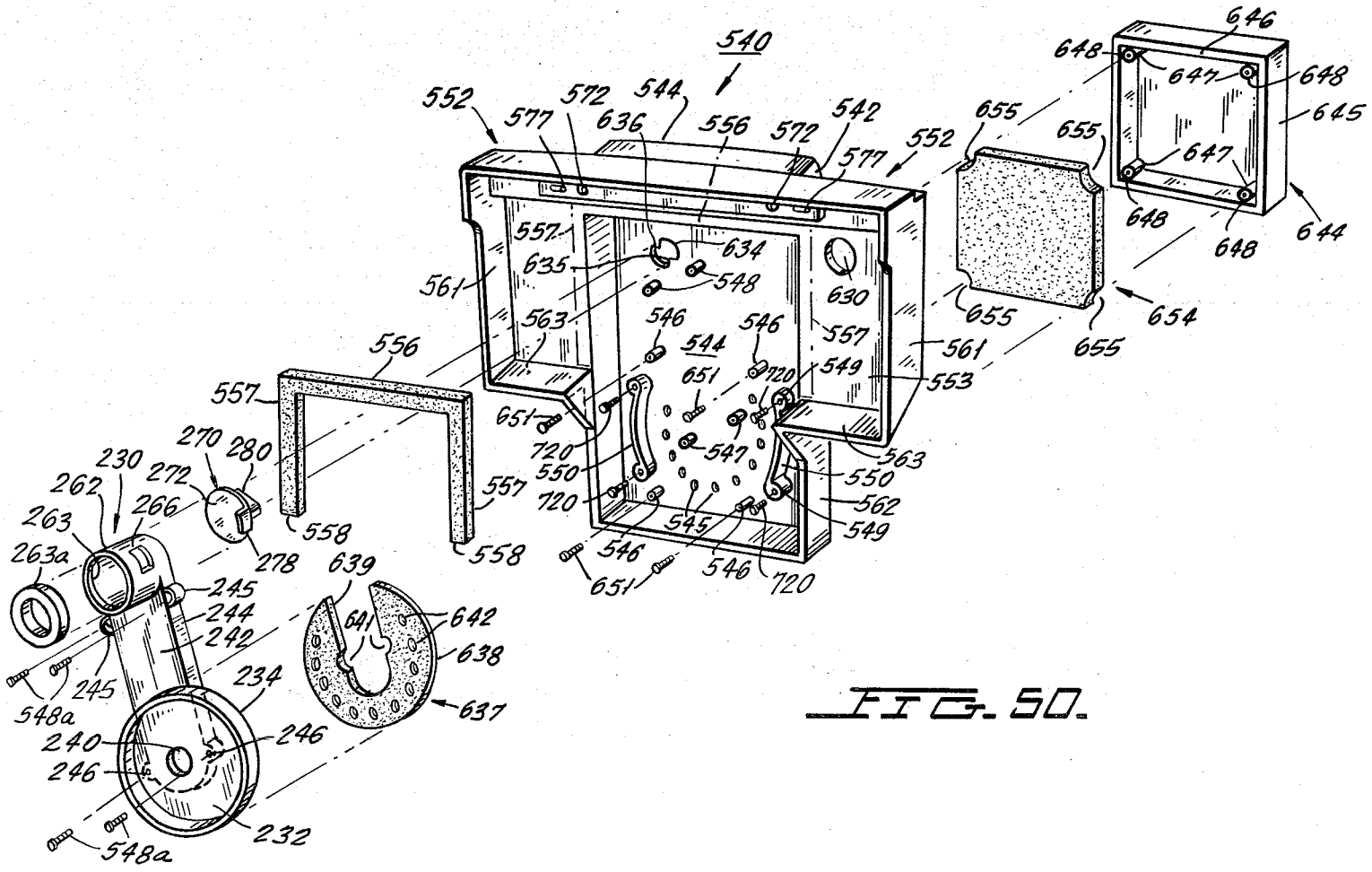
FIG. 50 is an exploded perspective view of the cover assembly over the top of the vacuum cleaner.

As shown in FIGS. 5 and 50, the cover top wall 544 is provided with an arcuate array of holes 545 therethrough which are above the plate 232 of the duct and through which the air expelled by the centrifugal fan 126 into the open space 241 beneath the plate 232 ultimately escapes from the vacuum cleaner. The holes 545 are located inwardly of the periphery of the plate 232 when the plate is assembled to the cover.

As shown in FIGS. 5, 7 and 50, integrally molded to extend both beneath the top wall 544 of the cover portion 542 and also very slightly above the top surface of the top wall are the four bosses 546, which are located beyond the periphery of the plate 232. The bosses 546 cooperate with the bosses 647 on the below described exhaust cover 644, which is outside the cover 540, for holding the exhaust cover 644 on the vacuum cleaner cover 540. The slight upraising of the tops of the bosses 546 pilots the lower ends 648 of the exhaust cover bosses 647 into position.

The underside of the top wall 544 of the cover portion 542 also carries two sets of downwardly depending bosses 547, 548 (FIGS. 4, 5 and 50) which seat upon the upstanding bosses 245, 246, respectively, which are positioned just outside the side walls 244 of the duct 240 (FIGS. 5 and 18). Appropriate screws **548*a* extend up through the openings in the respective bosses 245, 246 and are tightened into the openings in the cover bosses 547, 548. This additionally secures the duct and the plate assembly 230 rigidly to the cover 540**.

Finally, there are bosses 549 (FIGS. 4, 5, 6 and 50) which are located toward the side edges of the top portion 542 of the cover 540. The bosses 549 are at the terminal ends of the below described cover flanges 550. The bosses 549 extend from the top wall 554 down to sit upon the tops of the correspondingly positioned bosses 116 projecting up from the top of the motor housing 30. Screws 720, described below, project through these cooperating bosses and permanently hold the motor housing 30 and the cover 540 together. The motor 120 within the housing is securely pressed into position because the side walls 244, 543 defining the duct press up against the underside of the top wall 544 of the cover portion 542 and the mounting plate bottom 232 serves as the top wall of the housing for the main blower fan 126.

Additionally, integrally molded beneath and extending down from the cover top wall 544 are curved shaped motor hold down flanges 550 (FIGS. 5, 6 and 50) which also serve to damp noise transmission from the motor housing to the cover 540. With reference to FIGS. 6 and 50, the flanges 550 are curved and so placed as to both seat upon and pass around the periphery of the plate 232, which is the top wall of the motor casing itself and is directly beneath the main blower fan 126. Resilient material edge guides 551 are applied to the undersides of the flanges 550 which press against the plate 238. This damps vibration of the motor somewhat.

Also, motor sound is absorbed by the edge guides 551, which thereby muffles the projected sound of the vacuum cleaner somewhat. Finally, this contact locates the motor and the casing 122 vertically in the housing for assuring proper placement of the main blower fan 126.

To the rear of the portion 542, the cover 540 has a downwardly extending rear wall 560, which defines a flat surface which is obliquely oriented such that when the housing 540 is tilted open rearwardly, as described below (FIG. 2), the surface 560 rests flat on the ground for holding the cover stationary while it is open. The downwardly depending rear wall 560 of the cover portion 542 continues forward at the side walls 562 of that cover portion for containing exhausting air and for preventing entry of any objects into the vacuum cleaner mechanism.

It is necessary to prevent leakage down under the cover 540. Described later is the seal 556, 471 around the tank 300 for the forward side of the cover 540. There is also a seal defined under the rear portion of the upraised portion 542 of the cover 540 in the vicinity of the motor housing. With reference to FIGS. 7 and 8, it can be seen that shelf 42 has a width selected so that the depending lip 43 at the edge of the shelf is at and may engage, but is preferably spaced very slightly away from the interior surface of the rear wall 560 and the side walls 561 of the cover portion 542. The engagement of the lip 43 with the cover 540 is beneath the main blower fan 126. This engagement defines a seal against leakage and of motor noise carried along by the air. The fourth side of that leakage seal is defined by the strip 471 that passes across the front of the housing (FIG. 8).

At both sides of the portion 542 of the cover, there are the tank covering, lower height side portions 552. The top wall 553 of portion 552 is of a height to be at the top wall 412 of the tank 400 when the cover 540 is closed. In addition the top portion 542 of the cover 540 has a front wall 554 which extends down to the lower top wall 553, just to the rear of the lower front section 564 of the cover, thereby defining the narrow step 555 at the lower top wall 553 of the cover.

With reference to FIGS. 1*a*, 4, 5, 6 and 50, a U-shaped air seal element 556 comprised of foamed material is adhered to the underside of the lower top wall 553 of the cover extending around the border of the portion 542 of the cover. As can be seen in FIG. 4, the web of the U passes under the step 555 in the cover and over the top 410 at the front of the tank. The side arms 557 of the U pass rearwardly across the tank cover and in from the edges of the tank cover 410, until the ends 558 of the legs 557 abut the above described strip 471 (FIGS. 4 and 8). The complete strip 556, 471 defines a seal under the cover 540 preventing exit of air and noise from the exhaust of the main blower fan 126 down out of the upraised cover portion 542 and then past the tank 300 under the cover 540.

The material of which the element 556, as well as the strip 471, is comprised is a foamed plastic material and they are thick enough to be squeezed, creating the air seal, when the cover 540 is closed.

For esthetic reasons also and to prevent a user's fingers or other objects from entering the mechanism of the vacuum cleaner from the side, the portions 552 of the cover 540 have lateral side walls 561 and rear walls 563, and are closed off in front by the front section 564 of the cover, which extends across the full width of the cover. This is coupled with the somewhat baffled, tortuous pathway which the air exiting from the housing 30 necessarily follows, as illustrated by the outlet means 58, 62, as shown in FIGS. 7 and 11. The outleting air is free to move around under the cover 540. Air exits downwardly out of the vacuum cleaner through a large volume thereby reducing the velocity of the exiting air and decreasing the noise it generates.

Forward of the front section 564 of the cover, there is the front covering section 566, which hangs in front of the front portion 310 of the inlet nozzle. Joining the sections 564, 566 of the cover 540 is the inclined section 568 thereof. Depending beneath the section 568 of the cover 540 are the two spaced apart bosses 572.

A latch plate 576 shown in FIGS. 2–4, 6, 46 and 47 is secured at the underside of the bosses 572 by the screws 577, which are passed from the underside 578 of the latch plate 576 through the longitudinally elongated slot openings 580 and are then tightened into the threaded bores 582 of the bosses 572. As shown in FIG. 43, each screw 577 includes a threaded shaft 584 which is threadedly received in the threaded bore 582 and includes a head 586 by which the screw 577 is tightened into the threaded bore. The head 586 is larger in diameter than the (front-to-rear) width of an opening 580 so that the latch plate 576 will not fall off the bosses 572 to which the latch plate is mounted. Between its head 586 and shank 584, the screw has a shoulder 588 which is narrower in cross-section than the width of an opening 580 and taller than the thickness of the latch plate 576, whereby as the screw 577 is tightened, the surface 592 of the shoulder 588 is tightened against the underside of the boss 572, thereby spacing the underside 594 of the head 586 away from the underside of the boss 572 to provide clearance for lateral shifting of the latch plate 576.

Referring to FIGS. 6, 46 and 47, projecting up from the top of the latch plate 576 is the upstanding projection 596 which is adapted to be engaged by the cover latch button 597. The projection 596 is tall enough that the operable button 597 mounted on the projection is held above the section 568 of the cover 540. The projection 596 projects through the hole 601 in the section 568 of the cover 540.

The manually operable button 597 includes a row of depending fingers 599 and two of which receive between them the projection 596. The button 597 thereby becomes a part of the projection 596 and of the latch plate 576. Manual operation of the button 597 enables lateral shifting of the latch plate 576. The outer fingers 599 strike the sides of hole 601 to limit lateral motion of latch plate 576.

Figures 48, 49, 57, 57A, 58, 59:
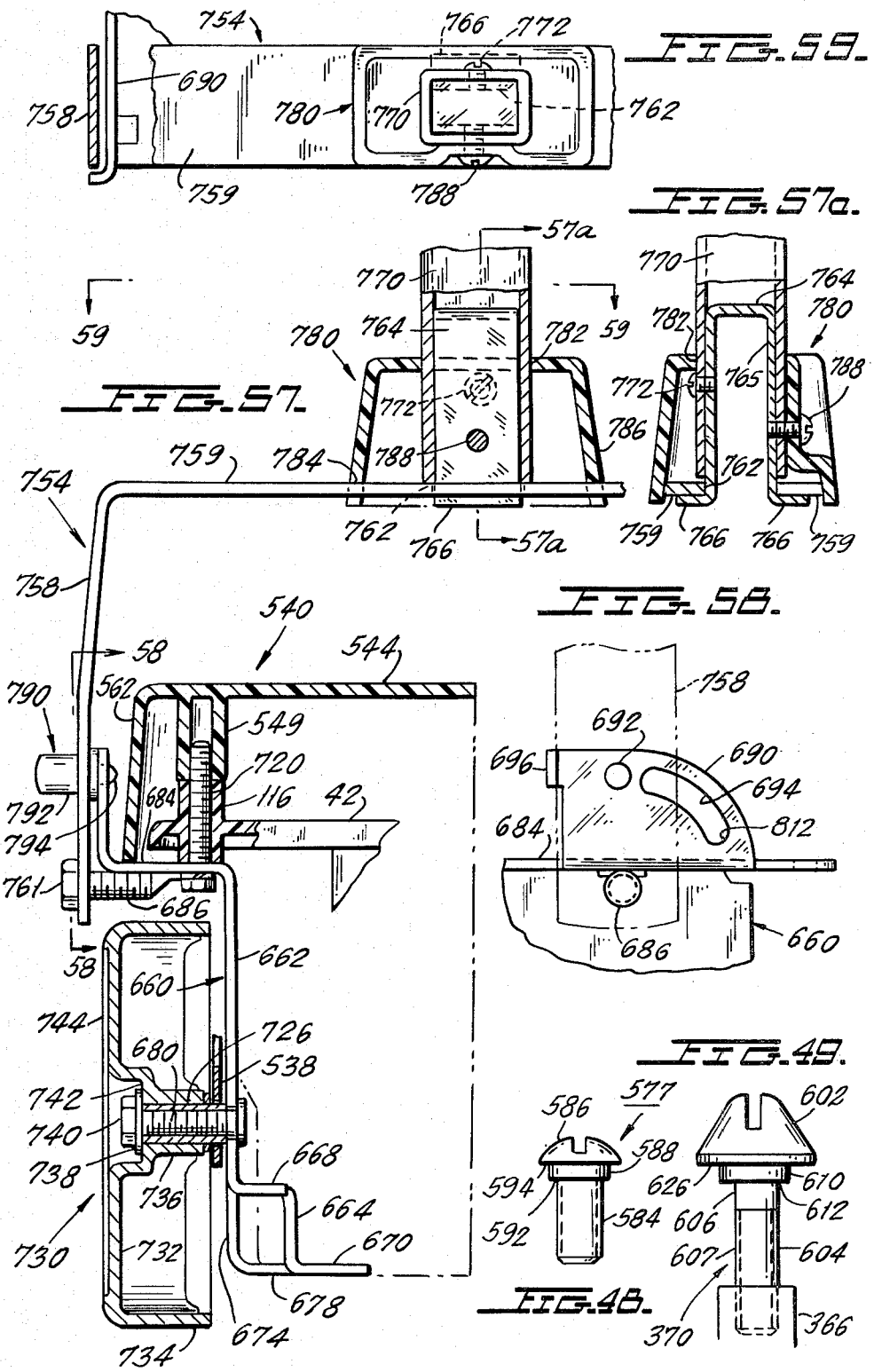
FIG. 48 is an elevational view of a bolt used for attaching the latch plate of FIG. 46 to the cover of the vacuum cleaner.
FIG. 49 is an elevational view of a bolt attached to the forward portion of the tank and cooperating with the latch plate for latching the cover closed over the tank.
FIG. 57 is a rear, elevational, cross-sectional view showing the securement of the wheels and the handle of the vacuum cleaner to the vacuum cleaner.
FIG. 57*a* is a fragmentary cross-sectional view showing the securement of the handle, and viewed along the line 57*a*—57*a* of FIG. 57.
FIG. 58 is a fragmentary view along the line 58—58 in FIG. 57 showing the means for controlling swivelling of the handle in FIG. 57.
FIG. 59 is a view along the line 59—59 of FIG. 57 showing means for latching the handle.

Latch plate 576 also has two holes 598 through it which are passed over the heads 602 of the bolts 370, shown in FIGS. 4, 6 and 49. The bolts 370 pass through the latch plate 576 and through the holes 311 in the front portion 310 of the nozzle and into the bosses 366 of the floor plate 362. The head 602 is rounded and steeply inclined on its sides to guide the latch plate 576 to be passed over it. The shaft 604 of the bolt 370 has an unthreaded section 606 which passes through the holes 311 in the nozzle front portion 310 and beneath that, it has a threaded section 607 which is tightened into the boss 366, until the top of the boss presses up against the undersurface of the front portion 310 of the inlet nozzle up to the tank. The shoulder 610 between the head 602 and the shaft section 606 is smaller in diameter than the opening 598. When the bolt 370 is tightened, the undersurface 612 of the shoulder 610 is tightened against the upper, outer surface of the front portion 310 of the tank nozzle. The height of the shoulder 610 is selected to permit free lateral shifting of the latch plate 576 with respect to the nozzle front portion 310 and thus with respect to the bolts 370.

A folded leaf spring 620 is attached at the boss 572 which is affixed to the cover 540, 568. The downwardly depending arm 622 of the spring engages the downwardly depending tang 624 at the end of the latch plate 576. The spring 620 normally urges the latch plate 576 to the left in FIGS. 6 and 46. As the latch plate 576 moves to the left under the influence of spring 620, the openings 598 are also shifted to the left and they are misaligned under the heads 602 of the bolts 370. Thus, the undersides 626 of the heads 602 abut the top surface 579 of the latch plate and this prevents the cover 540, to which the latch plate 576 is attached, from being lifted up and pivoted rearwardly, as described below.

To unlatch the cover 540 from the front portion of the inlet nozzle 310 of the tank, the button 597 is shifted to the right in FIG. 6 which charges the spring 620. Now the holes 598 are aligned beneath the bolt heads 602 and the cover 540 can be raised and tilted rearwardly, taking the latch plate 576 up with it. Upon the cover 540 being pivoted forward to be closed, the latch plate 576 is lowered into engagement with the the heads 602 of the bolts 370. The misalignment between the holes 598 and the bolt heads 602 is only slight, and the pointed heads 602 of the bolts extend into the holes 598 from beneath the latch plate 576. Slight downward pressure applied to the cover 540 causes the bolt heads 602 to urge the latch plate 576 to the right in FIG. 6, charging the spring 620, until the holes 598 are fully aligned with the bolt head 602. The latch plate then can slide down over the bolt heads and into the space beneath the underside 626 of the bolt heads. The spring 620 then returns the latch plate to the left in FIG. 6 and again latches the cover 540 closed.

As shown in FIG. 5, the top wall 553 of the shorter height portion 552 of the cover 540 has a circular hole 630 through it, which is positioned directly over and is shaped to provide access to the auxiliary hose inlet 440 in the tank cover 410. The plate 446 is correspondingly shaped so that in its solid line position, where it blocks the auxiliary hose inlet opening 440, it also blocks the entire opening 630 in the housing cover 540, thereby preventing leakage of air through the top wall 544 of the cover when it is not desired.

Figure 1A:
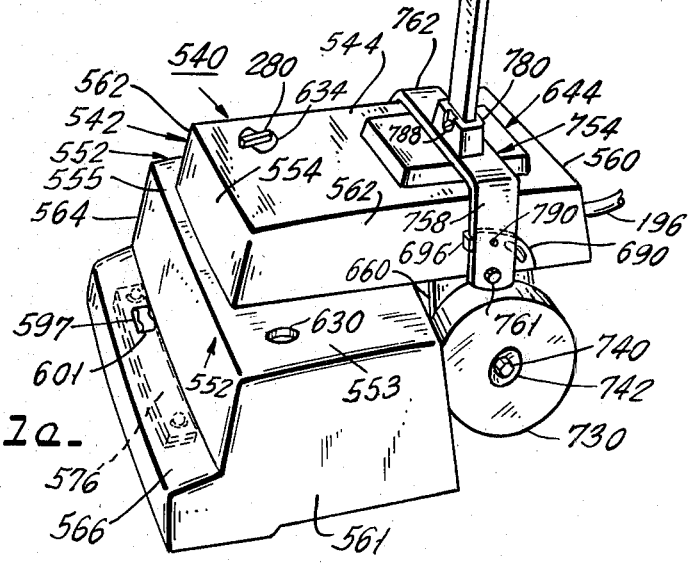
FIG. 1*a* is a side perspective view showing the vacuum cleaner in the cover closed condition.

The power regulator 270, which adjusts the mixture of the air flow into the main blower fan inlet 240, between flow from the tank and flow of ambient air from under the cover 540, must be adjusted in position from the exterior of the housing cover 540. Referring to FIGS. 1*a* and 5, the housing cover 540 has a nearly circular opening 634 in it which is positioned to overlie the power regulator handle 280, so that the power regulator handle 280, which sits on the top wall 412 of the tank 300, may project through it. The handle 280 would be free to rotate the disc 272 above the sleeve 262, except for the engagement between the depending side walls of the flange 278 on the power regulator 270. However, rotative motion of the handle 280 and thus of the disc 272 is even more confined between a fully opened position of the window 266, wherein the handle indicator 282 is pointing to the "wet" indicator on the cover 540 and wherein the side of handle abuts the flat 635 in the opening 634 and a fully closed position wherein the indicator 282 points to the "dry" indicator on the cover 540 and wherein the side of the handle engages the flat 636 in the opening 634.

With reference to FIGS. 4, 5 and 50, the exhausting air which is exhausted generally radially from the centrifugal fan 126 desirably exits from the vacuum cleaner through the cover 540 and the holes 545 therethrough. This air is moving rather rapidly and considerable noise is generated. It is desired, therefore, to slow the velocity of this air and to muffle the noise it generates. To this end, there is adhered to and beneath the cover top wall 544 the cover foam element 637, which, is spaced away from and above the plate 232 over the fan 126. As shown in FIG. 50, the foam element 637 is profiled so that its curved periphery 638 places it above, but somewhat in from the edge of the plate 232. The cover foam element 637 has a generally radial opening 639 defined in it, into which the plate 242 and its side walls 244 snuggly fit, with the bosses 245 being received in the notches 641 along the sides of the opening 639. An arcuate array of holes 642 passes through the cover foam element 637. The holes 642 are positioned to align with the holes 545 above them, whereby air that gets to the holes 642 passes out the cover holes 545.

The material of which the cover foam element 637 is comprised is a porous foamed plastic material. The air pockets inherently defined in the material tend to muffle noise and slow the velocity of air passing by them. The height of the foam cover element 637 is selected so that when the cover 540 is closed over the assembly 230 and the bottom of the foam element 637 is spaced from the plate 232, the air exhausted from fan 126, sealed into the space beneath the cover portion 542, is directed over the plate 232 and passes through the holes 642 and 545. The bends in the pathway of the air flow, plus the passage of the air through holes in the foam element 637, muffle the noise of the escaping air.

With reference to FIGS. 4 and 50, exhaust air exiting from the holes 545 does not simply blow straight up from the top of the vacuum cleaner. Instead, an additional exhaust cover 644 is positioned above the openings 545 and the solid surface of the cover 644 baffles air flowing out the openings 545. The exhaust cover 644 has a downwardly extending peripheral flange 645 around all of its sides, which extends down to the bottom 646 of the peripheral flange. Four downwardly depending bosses 647 are defined at the corners of the exhaust cover 644 and the bottom ends 648 of the bosses 647 are piloted into position by the slightly upraised bosses 546 and the bosses 647 are then supported on the top of the top wall 544 aligned with the bosses 546. An appropriate fastening means 651 passes through the bosses 546 and into the holes in the bosses 647, for securing the exhaust cover over the cover top wall 544. Because of the length of the bosses 647, a small clearance space 652 is defined around the entire bottom 646 of the flange 645 and air exhausted through the holes 545 in the cover 540 pass out the clearance space 652.

Adhered beneath the top surface of the exhaust cover 644 and having the peripheral profile defined by the interior of the flange 645 is the foam exhaust cover 654. The corners of the foam exhaust cover 654 are cut out at 655 to accomodate the bosses 647 under the exhaust cover 644. The periphery of the cover 654 fixes it against shifting under the exhaust cover 644. The height of the cover 654 is shorter than the height of the top surface of the exhaust cover 644 above the cover top wall 544, whereby a clearance space under the foam cover 654 is defined through which the exiting air passes to the exit clearance space 652. The material of which the foam cover 654 is comprised is the same type of foamed material as the above decribed cover foam element 637. Passage of the exiting air past the foam exhaust cover 654 muffles the motor noise being carried along by the exiting air.

A pair of brackets 660, 700 holds together the motor housing 30, the motor 122 and its casing 120 within the motor housing 30, the mounting plate 230 and the elements attached thereto and the cover 540 over the motor and motor housing to assemble them into an integral assembly. Furthermore, the brackets enable the entire combined assembly to swivel between an open, tank available for extraction, condition and a closed, vacuum cleaner completely assembled, condition.

FIGS. 1, 7, 51–53 and 57 show the bracket 660 on the one side of the vacuum cleaner and FIGS. 1 and 54–56 show the corresponding bracket 700 on the other side of the vacuum cleaner. Referring to FIGS. 51–53, the bracket 660 includes the flat plate 662. At one side thereof, the plate 662 has a depending leg 664, which includes three folds 666, 668, 669 giving the leg somewhat of a "W" shape. The folds 666, 668, 669 enable the support flange 670 at the end of leg 664 to extend under the motor housing bottom wall 112, which the bracket supports. Next to leg 664, and extending across toward the other side edge of the plate 662, the material of the plate has been folded to define the air flow prevention plate 671, which underlies the space leading up to the plate 230. The wide body 662 of this bracket, between its side edges, and the plate 671 together block recirculation up past the bracket 660 of now heated, contaminated air that has been exhausted from the cooling air outlet means 58, 62 of the motor housing. Also the flat plate 662 and plate 671 block dirt and liquid from splashing up to the plate 230.

At the other lateral side of the plate 662 from the leg 664, there is the second depending leg 674 which is folded at 676 to define the support flange 678. The support flange 678 also extends beneath the motor housing bottom wall 112. The shape of the motor housing 30 and particularly the side and bottom walls thereof determines the length and shape of the legs 664, 670 and 674, 678.

A threaded stud 680 is affixed to and projects outwardly (to the right in FIG. 52) from the outwardly facing side of the plate 662 for serving as the axle for the below described wheel 730.

A tang 682 projects outwardly of plate 662 and serves as a retainer for holding the hook 524, 538 on the axle 680, so that the tank 300 stays in place as the vacuum cleaner is used. The tang 682 may obstruct upward motion of the hook, but does not prevent its voluntary lifting for tank removal.

At its top end, the bracket 660 is folded outwardly, defining the shelf 684. A pivot stud 686 has a rear portion that is welded to the underside of the shelf 684 and a threaded forward portion that projects outwardly of the vacuum cleaner past the shelf 684. This stud cooperates with a hole 758*a* in the below described yoke drum 758 and this serves as a pivot mount for the yoke 754 and handle 770 of the vacuum cleaner, which are described below.

At the opposite ends of the shelf 684, there are holes 687, 688 which are respectively alignable with the undersides of the bosses 116 along one side of the motor housing 30, as shown in FIG. 7.

Toward the rear half of the bracket 660 the upstanding flange 690 is formed. It aids in locking the vacuum cleaner handle 754, 770 in a number of different positions. The flange 690 has the general shape of the upper right quadrant of a circle. Along the vertical radius of the flange 690, a hole 692 has been provided. A slot 694, curved around the stud 686 as its center, curves down along the flange 690. The yoke 754 includes a snap detent arrangement, described below, which can be snapped into the hole 692 for holding the handle in the upright condition or which can be snapped into the slot 694, which then enables the handle to travel along the slot to various positions as the vacuum cleaner is moved during use. The bracket flange 690 extends forward in the vacuum cleaner, over the vertical center line, to its portions 695. The portion 695 supports a small bumper flange 696 placed so as to block swiveling of the yoke 754 too far forward.

With reference to FIGS. 1, 54, 55 and 56, the bracket 700 is provided on the opposite side of the vacuum cleaner from the bracket 660. The bracket 700 is essentially a mirror image of the bracket 660. The bracket 700 includes the plate 702, the threaded stud 704 for serving as the other axle of the vacuum cleaner, the shelf 706 beneath which the threaded pivot stud with the forward portion 708 is welded for serving as a pivot stud cooperating with the other arm 760 of the yoke 754, serving as the pivot for the yoke and the handle, the leg 710 which engages the front of the motor housing 30, the air flow prevention plate 711 next to the leg 710, the leg 712 which engages the rear of the housing 30, the tank support hook retention tang 714, the holes 716 in the shelf 706 which correspond to the holes 687, 688, etc. The principal distinction between the brackets 700 and 660 is the absence in the bracket 700 of a flange functioning like the flange 690, as it is presently contemplated that only a single flange controlling the position of the handle of the vacuum cleaner is required.

With reference to FIG. 7, for holding the assembly of the motor housing 430, motor 120, mounting plate 230 and cover 540 together as a unit, at each pair of bosses 116, 546, beneath each of the holes 687, 688, 716 and the bracket shelves 684, 706, a bolt 720 is passed from beneath the respective bracket shelf 684, 706 through the respective hole in the bracket shelf, through the boss 116 at the top of the housing 30 which boss has a clearance opening through it for through passage of the bolt 720 and the bolt 720 is screwed into the threaded orifice 722 in the boss 549 in the cover 540. Tightening of the bolt 720 holds the entire assembly together. In this way also, the housing 30 and the cover 540 are securely attached to the axle 680. It is apparent that just as the below described wheels 730 can rotate about their axles 680, 704, the housing 30 and attached cover 540 can be pivoted about the axle 680 between the closed condition of the cover illustrated in FIG. 1*a* and the open condition of the cover illustrated in FIG. 2.

With reference to FIG. 57, a bushing 726 is positioned on the threaded axle 680 and is freely rotatable about the stationary axle 680. The bushing 726 serves as the bearing for the wheel 730. The wheel 730 is comprised of a disc having an outer face 732, an annular tire portion 734 on which the wheel runs and a hub portion 736 having an opening therethrough which is sized for being press-fit over the bushing 726. A washer 738 and nut 740 threadedly tightened onto the threaded axle 680 are sized to engage the outwardly facing surface 742 of the hub 736 for holding the wheel 730 securely on the bushing 726. A decorative covering plate 744 covers the exterior of the wheel. As the vacuum cleaner is moved, both wheels 730 roll. Correspondingly, as the motor housing 30 and cover 540 are tilted forwardly and rearwardly (FIGS. 1 and 2), the wheels 730 may remain stationary.

Handle means for the vacuum cleaner are provided. For supporting the handle means, the studs 686, 708 are of a length, as shown in FIG. 57, sufficient to extend out beyond the respective wheels 730.

The yoke 754, to be next described, is the same at both sides of the vacuum cleaner, whereby details of the yoke at only one side of the vacuum cleaner are shown and described.

Referring to FIGS. 1 and 57–59, the yoke 754 is generally U-shaped. Referring to FIG. 57, the yoke has an upstanding arm portion 758 with a hole 758*a* passing through it for receiving the stud 686 in it. A sleeve in that opening permits rotation of the stud in the hole 758*a*. The stud extends through the yoke arm portion 758 and is secured in place by the nut 761. The yoke arm can pivot about the stud 686.

The arm 758 is inclined slightly inwardly moving upwardly along the yoke 754. The yoke has a horizontal web 759 which joins the arm 758 and its opposite arm 760. The opposite arm 760 also has an equivalent hole for receiving the other pivot stud 708.

Along the web 759 of the yoke, at the center thereof, an opening 762 is formed, which is of a size for securing the handle attachment clip 764 in position. The clip 764 is U-shaped with legs 765 that respectively face toward the side margins of the web 759 of the yoke. At the bottom of each leg of the clip is a respective flap 766 which extends out toward the adjacent edge of the web 759 and the flaps 766 are spot welded to the underside of the web 759, by which means the clip 764 is secured to the yoke.

The clip 764 is provided for the purpose of receiving the end of the handle 770 on it and for supporting the handle in position.

The swiveling of the yoke 754 is around an axis defined by the studs 686, 708, which are pivotable in the holes 758*a* in the yoke.

The handle 770 comprises a hollow shaft having a rectangular cross-section so that the handle may be received on and over the clip 764. A bolt 772 is passed through the handle 770 and a hole in the clip 764.

A decorative hollow cover 780, with a hole 782 at its top end profiled for grippingly holding to the handle shaft 770 beneath it, is fitted over the handle and the bottom 784 of the peripheral wall 786 rests atop the yoke web 759. A screw 788 extends through a hole in the cover 780 and through the handle 770 into the clip 764 within, whereby the cover is fastened into position and the handle is held by two screws to the clip and, therefore, to the yoke.

The handle 770 is thereby integrated with the yoke 754 and they move together as a unit. The handle 770 extends up to the conventional manual grip 776 (FIG. 1*a*).

As noted above, the handle 770 can be tilted. Control over the extent to which the handle and yoke combination can be tilted is desired. Furthermore, it is desired that the handle be able to be latched upright for storage of the vacuum cleaner. For these purposes, a spring loaded detent means 790 is supported on the yoke arm 758. It is a very simple unit comprised of the housing 792 affixed to the yoke arms 758 and a plunger within the housing and having the detent pin 794 projecting out of the housing toward the bracket flange 690. The spring (not shown) always urges the pin 794 toward the flange 690. The pin 794 is long enough that it either engages the wall of the flange or falls into the hole 692 or slot 694 of the flange. The end of the pin 794 is rounded so that when the pin encounters the edges of the hole 692 or the slot 694, the pin 794 is urged into its housing 792 and the yoke is freed to shift. It is contemplated that with the pin 794 in the hole 692, the yoke and handle will be held upright. The slot 694 guides and controls the extent of swivelling of the handle during normal use. The previously mentioned flange 696 on the flange 690 defines the forward most point of swivel movement of the handle 770 where the arm 758 of the yoke strikes against that flange. If it is desired to lift the front of the vacuum cleaner up during use, then the handle 770 is moved rearwardly and downwardly. The pin 794 eventually touches the lower end 812 of the slot 694 and further movement tilts the bracket 690 and the whole vacuum cleaner backward. Similarly, if the cover 540 has been unlatched from the tank nozzle 310, correspondingly tilting the handle 770 to the rear will raise the cover 540 off the tank 300 without raising the nozzle 310 off the floor.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A vacuum cleaner, comprising:

a suction inlet;

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

said tank has upstanding side walls and has a bottom and a top; said suction inlet being located at said tank bottom; said tank inlet nozzle extending up from said suction inlet toward said tank top; said inlet nozzle terminating in an exit located toward said top of said tank;

an auxiliary inlet to said tank located away from said suction inlet and said inlet nozzle; closing means for selectively closing one of said inlet nozzle to said tank and said auxiliary inlet to said tank, while causing the other of said inlet nozzle and said auxiliary inlet to remain open;

a housing for said blower fan motor; separable attachment means for separably attaching said tank to said housing, whereby said housing and said tank are operated together as a vacuum cleaner and said tank may also be separated from said housing.

2. The vacuum cleaner of claim 1, wherein said closing means comprises a plate movable between a position thereof blocking said inlet nozzle and a position thereof blocking said auxiliary inlet and said closing means plate being shaped and positioned so as to close the respective one of said inlet nozzle and said auxiliary inlet.

3. A vacuum cleaner, comprising:

a suction inlet;

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

said suction inlet being adapted to be moved over a surface to be vacuum cleaned; said tank including first surface contact means for contacting the surface to be vacuum cleaned, whereby said tank provides support for the vacuum cleaner on the surface to be vacuum cleaned; said first surface contact means support said suction inlet a predetermined height off the surface to be vacuum cleaned;

a housing for said blower fan motor; separable attachment means for separably attaching said tank to said housing, whereby said housing and said tank are operated together as a vacuum cleaner and said tank may also be separated from said housing.

4. The vacuum cleaner of claim 3, wherein said separable attachment means comprises a projection from one of said tank and said housing engaging a support for said projection on the other of said tank and said housing.

5. A vacuum cleaner, comprising:

a suction inlet;

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

said suction inlet being adapted to be moved over a surface to be vacuum cleaned; said tank including first surface contact means for contacting the surface to be vacuum cleaned, whereby said tank provides support for the vacuum cleaner on the surface to be vacuum cleaned;

a housing for said blower fan motor; separable attachment means for separably attaching said tank to said housing, whereby said housing and said tank are operated together as a vacuum cleaner and said tank may also be separated from said housing;

said vacuum cleaner having a front and a rear; said tank being located toward said vacuum cleaner front; said tank having a front side wall; said suction inlet being at said front wall of said tank at said vacuum cleaner front; said motor housing being positioned to the rear of said tank.

6. The vacuum cleaner of claim 5, further comprising second surface contact means connected with said blower fan motor housing and also being for contacting the surface to be vacuum cleaned, whereby both said tank and said housing provide support for the vacuum cleaner on the surface to be vacuum cleaned.

7. The vacuum cleaner of claim 5, wherein said separable attachment mean comprises a projection from one of said tank and said housing engaging a support for said projection on the other of said tank and said housing.

8. The vacuum cleaner of claim 5, further comprising a brush at and extending beneath said tank bottom and extending across said tank bottom between the sides of said tank and being located rearwardly of said suction inlet, for guiding materials on the surface to be vacuum cleaned into said suction inlet.

9. The vacuum cleaner of claim 8, wherein said brush is comprised of a strip of material extending across said tank bottom and rearward of said suction inlet.

10. The vacuum cleaner of claim 5, wherein said tank has a front wall at the front of said vacuum cleaner and said suction inlet projects forwardly of said tank front wall and has a forward top wall at a height much less than the height of said front wall, thereby causing said suction inlet to be under a predetermined low height and to be a forwardly projecting part of said tank.

11. The vacuum cleaner of claim 5, wherein said vacuum cleaner has a front and a rear;

a brush at and extending beneath said tank bottom, located rearwardly of said suction inlet, for guiding materials on the surface to be vacuum cleaned into said suction inlet.

12. The vacuum cleaner of claim 11, wherein said brush is comprised of a strip of material extending across said tank bottom and rearward of said suction inlet.

13. The vacuum cleaner of claim 12, wherein said brush is comprised of a material that is able to push particulates and liquid on the surface to be vacuum cleaned toward said suction inlet.

14. A vacuum cleaner, comprising a suction inlet;

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

said tank has upstanding side walls and has a bottom and a top; said suction inlet being located at said tank bottom; said tank nozzle extending up from said suction inlet toward said tank top; said inlet nozzle terminating in an exit located toward said top of said tank;

said tank has a covering wall toward which said inlet nozzle exit terminates, such that air and materials exiting from said inlet nozzle into said tank first impinge upon said tank covering wall;

said tank outlet is laterally spaced in said tank away from said inlet nozzle exit into said tank, whereby materials exiting from said inlet nozzle may fall into said tank rather than moving directly toward said tank outlet;

a housing for said blower motor; separable attachment means for separably attaching said tank to said housing, whereby said housing and said tank are operated together as a vacuum cleaner and said tank may also be separated from said housing;

and an auxiliary inlet to said tank located away from said suction inlet and said inlet nozzle; closing means for selectively closing one of said inlet nozzle to said tank and said auxiliary inlet to said tank, while causing the other of said inlet nozzle and said auxiliary inlet to remain open.

15. The vacuum cleaner of claim 14, wherein said closing means comprises a plate movable between a position thereof blocking said inlet nozzle and a position thereof blocking said auxiliary inlet and said closing means plate being shaped and positioned so as to close the respective one of said inlet nozzle and said auxiliary inlet.

16. A vacuum cleaner, comprising:

a suction inlet:

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

said tank has upstanding side walls and has a bottom and a top; said suction inlet being located at said tank bottom; said tank nozzle extending up from said suction inlet toward said tank top; said inlet nozzle terminating in an exit located toward said top of said tank;

said tank has a covering top wall toward which said inlet nozzle exit terminates, such that air and materials exiting from said inlet nozzle into said tank first impinge upon said tank covering wall;

said tank outlet is located in said covering wall and is laterally spaced in said tank away from said inlet nozzle exit into said tank, whereby materials exiting from said inlet nozzle exit may fall into said tank rather than moving directly toward said tank outlet;

a housing for said blower fan motor; separable attachment means for separably attaching said tank to said housing, whereby said housing and said tank are operated together as a vacuum cleaner and said tank may also be separated from said housing;

said covering wall has materials redirecting means in it shaped and placed so as to have the materials exiting from said inlet nozzle exit first impinge upon said redirecting means; said materials redirecting means being shaped for causing the materials moving out of said inlet nozzle exit to change direction upon impinging upon said materials redirecting means, thereby causing those materials to drop into said tank and separate from the inflowing air exiting from said inlet nozzle exit;

said inlet nozzle exit opens toward said top wall; said materials redirecting means comprises a curved surface, which is concave toward said inlet nozzle exit and into said tank; said inlet nozzle exit directing materials generally toward one end of the curve of said redirecting means, and said redirecting means being curved for directing the air stream in a plane offset from said tank outlet.

17. The vacuum cleaner of claim 16, further comprising an auxiliary inlet to said tank located away from said suction inlet, said inlet nozzle and said materials redirecting means; closing means for selectively closing one of said inlet nozzle to said tank and said auxiliary inlet to said tank, while causing the other of said inlet nozzle and said auxiliary inlet to remain open.

18. The vacuum cleaner of claim 17, wherein said closing means comprises a plate movable between its position blocking said inlet nozzle and its position blocking said auxiliary inlet and said closing means plate being shaped and positioned so as to close the respective one of said inlet nozzle and said auxiliary inlet.

19. A vacuum cleaner, comprising:

a suction inlet;

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

said tank has upstanding side walls and has a bottom and a top; said suction inlet being located at said tank bottom; said tank inlet nozzle extending up from said suction inlet toward said tank top; said inlet nozzle terminating in an exit located toward said top of said tank;

said tank has a covering wall toward which said inlet nozzle exit terminates, such that air and materials exiting from said inlet nozzle into said tank first impinge upon said tank covering wall;

said vacuum cleaner has a front and a rear; said tank has a front and a rear wall, with respect to the front and the rear of the vacuum cleaner, respectively; said tank has side walls joining said front and said rear walls thereof;

said inlet nozzle starts at said suction inlet on said tank bottom; said suction inlet comprises an opening extending across said tank in the direction between said side walls; said suction inlet being narrower in the dimension between said front and said rear walls of said tank moving outwardly toward said side walls of said tank; moving upwardly of said tank from said suction inlet, said inlet nozzle becoming progressively narrower between said tank side walls, but deeper between said tank front and rear walls, and said inlet nozzle extending up to a section thereof that is located near to said tank top;

a housing for said blower fan motor; separable attachment means for separably attaching said tank to said housing, whereby said housing and said tank are operated together as a vacuum cleaner and said tank may also be separated from said housing said vacuum cleaner further comprising an enclosing cover over said motor housing and said tank, support means associated with said motor housing; and said tank being separable from said cover, motor housing and support means.

20. The vacuum cleaner of claim 19, wherein said covering wall has materials redirecting means in it shaped and placed so as to have materials exiting from said inlet nozzle exit first impinge upon said redirecting means; said materials redirecting means being shaped for causing the materials moving out of said inlet nozzle exit to change direction upon impinging upon said materials redirecting means, thereby causing those materials to drop into said tank and to separate from the inflowing air exiting from said inlet nozzle exit.

21. The vacuum cleaner of claim 20, wherein said tank outlet is laterally spaced in said tank away from said inlet nozzle exit into said tank and said materials redirecting means, whereby materials exiting from said inlet nozzle exit may fall into said tank rather than moving directly toward said tank outlet.

22. The vacuum cleaner of claim 19, wherein said suction inlet is adapted to be moved over a surface to be vacuum cleaned; said tank including first surface contact means for contacting the surface to be vacuum cleaned, whereby said tank provides support for the vacuum cleaner on the surface to be vacuum cleaned.

23. The vacuum cleaner of claim 22, wherein said vacuum cleaner has a front and a rear; said tank being located toward said vacuum cleaner front; said tank having a front side wall; said suction inlet being at said front wall of said tank at said vacuum cleaner front; said motor housing being positioned to the rear of said tank.

24. The vacuum cleaner of claim 22, further comprising second surface contact means connected with said blower fan motor housing and also being for contacting the surface to be vacuum cleaned, whereby both said tank and said housing provide support for the vacuum cleaner on the surface to be vacuum cleaned.

25. The vacuum cleaner of claim 24, wherein said first surface contact means support said suction inlet a predetermined height off the surface to be vacuum cleaned.

26. The vacuum cleaner of claim 19, wherein said tank has a front wall at said front of said vacuum cleaner and said suction inlet projects forwardly of said tank front wall and has a forward top wall at a height much less than the height of said front wall, thereby causing said suction inlet to be at and under a predetermined low height, to be a forwardly projecting part of said tank.

27. The vacuum cleaner of claim 18, further comprising a brush at and extending beneath said tank bottom and extending across said tank bottom between the sides of said tank and being located rearwardly of said suction inlet, for guiding materials on the surface to be vacuum cleaned into said suction inlet.

28. The vacuum cleaner of claim 27, wherein said brush is comprised of a strip of material;

said brush is comprised of a material that is able to push particulates and liquid on the surface to be vacuum cleaned toward said suction inlet.

29. A vacuum cleaner, comprising:

a suction inlet;

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

a housing for said blower fan motor; said tank being separably attached to said housing, whereby said housing and said tank are operated together as a vacuum cleaner and said tank may also be separated from said housing;

said tank has upstanding side walls and has a bottom and a top; said suction inlet being located at said tank bottom; said tank inlet nozzle extending up from said suction inlet toward said tank top; said inlet nozzle terminating in an exit located toward said top of said tank;

said tank has a covering wall toward which said inlet nozzle exit terminates, such that air and materials exiting from said inlet nozzle into said tank first impinge upon said tank covering wall;

said vacuum cleaner has a front and a rear; said tank being located toward said vacuum cleaner front; said tank having a front side wall; said suction inlet being at said front wall of said tank at said vacuum cleaner front; said motor being positioned to the rear of said tank; and resilient material interposed between said front side of the housing and said covering wall of said tank and both said housing at said front side thereof and said tank covering wall engaging said resilient material.

30. The vacuum cleaner of claim 29, wherein said tank has a top wall at said top thereof and said covering wall is said tank top wall; said tank outlet being formed in said tank top wall.

31. A vacuum cleaner, comprising:

a suction inlet;

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

a housing for said blower fan motor; said housing having an inlet for a flow of cooling air into said housing for cooling said motor; said housing having an outlet for cooling air that has blown over said motor for cooling said motor;

said vacuum cleaner has a front and a rear; said tank being located toward said vacuum cleaner front; said tank having a front toward said front of said vacuum cleaner; said tank having a rear; said suction inlet being at said front of said tank; said motor housing being to the rear of said tank;

said motor in said housing is enclosed in a motor casing and said casing is located in said housing; a cooling fan located in said casing for blowing cooling air over said motor; said casing having an inlet to said cooling fan and having an outlet placed so that air blown over said motor by said cooling fan will exit through said casing outlet;

a baffle in said housing for separating the air that has entered said housing for cooling said motor from the air that has passed over said motor and that is exiting from said housing; said baffle in said housing dividing said housing into one chamber communicating with said casing inlet and another chamber communicating with said casing outlet.

32. The vacuum cleaner of claim 31, wherein said tank is separably attached to said housing and wherein said tank may be separated from said housing.

33. The vacuum cleaner of claim 31, wherein said tank has upstanding said walls and has a bottom and a top; said suction inlet being located at said tank bottom; said tank inlet nozzle extending up from said suction inlet toward said tank top; said inlet nozzle terminating in an exit located toward said top of said tank.

34. The vacuum cleaner of claim 33, wherein said motor housing inlet is located at said rear of said vacuum cleaner and said motor housing outlet is located at a side of said housing which extends from said rear of said vacuum cleaner toward said front thereof.

35. A vacuum cleaner, comprising:

a suction inlet;

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

a housing for said blower fan motor; said housing having an inlet for a flow of cooling air into said housing for cooling said motor; said housing having an outlet for cooling air that has blown over said motor for cooling said motor;

said vacuum cleaner has a front and a rear; said tank being located toward said vacuum cleaner front; said tank having a front toward said front of said vacuum cleaner; said tank having a rear; said suction inlet being at said front of said tank; said motor housing being to the rear of said tank;

said tank has upstanding said walls has a bottom and a top; said suction inlet being located at said tank bottom; said tank inlet nozzle extending up from said suction inlet toward said tank top; said inlet nozzle terminating in an exit located toward said top of said tank;

said motor housing inlet is located at said rear of said vacuum cleaner and said motor housing outlet is located at a side of said housing which extends from said rear of said vacuum cleaner toward said front thereof; said motor housing has a bottom and a top; said housing inlet and outlet both being near said top of said housing so that material on the surface to be vacuum cleaned is inhibited from entering said housing through said inlet and said outlet.

36. The vacuum cleaner of claim 35, wherein said motor in said housing is enclosed in a motor casing and said casing is located in said housing; a cooling fan located in said casing for blowing cooling air over said motor; said casing having an inlet to said cooling fan and having an outlet placed so that air blown over said motor by said coolng fan will exit through said casing outlet;

said baffle in said housing dividing said housing into one chamber communicating with said casing inlet and another chamber communicating with said casing outlet.

37. A vacuum cleaner, comprising:

a suction inlet;

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

a housing for said blower fan motor; said housing having an inlet for a flow of cooling air into said housing for cooling said motor; said housing having an outlet for cooling air that has blown over said motor for cooling said motor;

a baffle in said housing for separating the air that has entered said housing for cooling said motor from the air that has passed over said motor and that is exiting from said housing;

a duct connecting said tank outlet and said blower fan;

said tank being separably attached to said housing and wherein said tank may be separated from said housing;

said duct being rigidly attached to said motor housing, whereby said tank being separable from said duct and said duct is attachable to said tank outlet without said duct being removed from said motor housing.

38. The vacuum cleaner of claim 37, wherein said motor housing has a top side thereof with respect to the top of the vacuum cleaner and said blower fan is supported near said top side of said motor housing;

said blower fan having an inlet side thereof which faces toward the top of said vacuum cleaner; said tank having a top wall in which said tank outlet is formed;

said duct being seated atop said tank top wall and also atop said blower fan inlet side for joining said tank outlet and said blower fan inlet.

39. The vacuum cleaner of claim 30, further comprising an air flow rate regulator for said duct for blocking flow from said tank outlet to said blower fan inlet to a selected extent.

40. The vacuum cleaner of claim 39, wherein said duct also communicates with the exterior of said tank, and said power regulator divides a generally constant flow of air to said blower fan inlet, between flow through said duct from said tank outlet and flow from outside said tank,

41. A vacuum cleaner, comprising:

a suction inlet;

a blower fan in communication with said suction inlet for drawing air and other materials into said suction inlet; an outlet path for air from said blower fan; a motor for driving said blower fan; a housing for said blower fan motor;

said housing has a top with respect to the top of the vacuum cleaner and said blower fan is positioned near said top of said housing; said blower fan has an inlet side which faces upwardly toward the top of said vacuum cleaner; said tank having a top wall at the top thereof and said tank outlet being positioned at said top wall of said tank;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank; said tank outlet being at a wall of said tank;

a duct connecting said tank outlet and said blower fan; said duct extending between said top wall of said tank and said top of said housing; said duct being seated atop said tank top wall and also above said blower fan inlet side for joining said tank outlet and said blower fan inlet.

42. The vacuum cleaner of claim 41, further comprising a cover above and spaced from the top of said blower fan housing; said duct extending up to said cover and said cover defining the top of said duct.

43. The vacuum cleaner of claim 42, wherein said duct also communicates externally of said tank;

a power regulator for said duct for blocking flow from said tank outlet to said blower fan to a selected extent, and said power regulator divides a generally constant flow of air to said blower fan, between flow through said duct from said tank outlet and flow from outside said tank.

44. The vacuum cleaner of claim 43, wherein said duct communicates externally of said tank under said cover.

45. A vacuum cleaner, comprising:

a suction inlet;

a blower fan in communication with said suction inlet for drawing air and other materials into said suction inlet; an outlet path for air from said blower fan; a motor for driving said blower fan; a housing for said blower fan motor;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank; said tank outlet being at a wall of said tank;

a cover above and spaced from the top of said blower fan housing;

a duct connecting said tank outlet and said blower fan; said duct comprising a bottom plate extending between said tank outlet and said blower fan at said inlet side thereof, and said plate communicating with both of these; duct closing side walls on said plate extending up to said cover; said duct closing side walls, said bottom plate and said cover closing and defining said duct.

46. The vacuum cleaner of claim 45, further comprising an air flow rate regulator for said duct for blocking flow from said tank outlet to said blower fan to a selected extent.

47. The vacuum cleaner of claim 46, wherein said duct also communicates with the exterior of said tank, and said air flow rate regulator divides a generally constant flow of air to said blower fan, between flow through said duct from said tank outlet and flow from outside said tank.

48. The vacuum cleaner of claim 47, wherein said duct includes a window therein for communication externally of said tank; said air flow rate regulator including flange means thereon for closing said window and including means for moving said flange means selectively to close and open said window.

49. The vacuum cleaner of claim 45, wherein said motor housing is secured to said cover, and said duct is captured between said housing and said cover.

50. The vacuum cleaner of claim 49, further comprising latching means for separably latching said cover to said tank, and for unlatching said cover from said tank for permitting said tank to be separated from said cover and thereby from said housing.

51. The vacuum cleaner of claim 45, further comprising a yoke swivelably attached to said cover and a handle supported by said yoke; means connected with said cover for enabling controlled swiveling of said yoke with respect to said cover.

52. The vacuum cleaner of any of claims 42, 44 or 45, wherein said cover also extends over said tank for covering over both said housing and said tank.

53. The vacuum cleaner of claim 52, further comprising a pivot mount for said cover for permitting said cover to be pivoted between a position at which said cover is over said tank and a position at which said cover is separated from said tank; said cover remaining attached to said housing.

54. The vacuum cleaner of claim 52, wherein said motor housing is secured to said cover, and said duct is captured between said housing and said cover.

55. The vacuum cleaner of claim 54, further comprising latching means for separably latching said cover to said tank, and for unlatching said cover from said tank for permitting said tank to be separated from said cover and thereby from said housing.

56. The vacuum cleaner of claim 55, further comprising a pivot mount for said cover for permitting said cover to be pivoted between a position at which said cover is latched to said tank and a position at which said cover is separated from said tank; said cover remaining attached to said housing.

57. A vacuum cleaner, comprising:

a suction inlet;

a blower fan in communication with said suction inlet for drawing air and other materials into said suction inlet; an outlet path for air from said blower fan; a motor for driving said blower fan;

a tank interposed between said suction inlet and said blower fan for receiving materials drawn in through said suction inlet; said tank having an inlet nozzle communicating with said suction inlet; said inlet nozzle having a smaller cross-section than the cross-section of said tank, whereby air flow is slowed in said tank so that collected materials settle in said tank; an air outlet from said tank communicating with said blower fan;

a housing for said blower fan motor; separable attachment means for separably attaching said tank to said housing, whereby said housing and said tank are operated together as a vacuum cleaner and said tank may also be separated from said housing;

a duct connecting said tank outlet and said blower fan;

said blower fan is positioned near the top of said housing; said blower fan has an inlet side which faces upwardly toward the top of said vacuum cleaner;

said tank also having a top with respect to the top of the vacuum cleaner and said tank outlet being positioned at said top of said tank; said duct extending from between the top of said tank and the top of said housing at said blower fan inlet side;

a cover over the top of said housing.

58. The vacuum cleaner of claim 57, further comprising a yoke swivelably attached to said cover and a handle supported by said yoke; means connected with said cover for enabling controlled swiveling of said yoke with respect to said cover.

59. The vacuum cleaner of claim 57, further comprising latching means for separably latching said cover to said tank, and for unlatching said cover from said tank for permitting said tank to be separated from said cover and thereby from said housing.

60. The vacuum cleaner of claim 59, further comprising a pivot mount for said cover for permitting said cover to be pivoted between a position at which said cover is latched to said tank and a position at which said cover is separated from said tank; said covering remaining attached to said housing.

61. The vacuum cleaner of claim 60, further comprising a yoke swivelably attached to said cover and a handle supported by said yoke; means connected with said cover for enabling controlled swiveling of said yoke with respect to said cover.

62. The vacuum cleaner of claim 59, wherein said motor housing is secured to said cover, and said duct is thereby captured between said housing and said cover.

63. The vacuum cleaner of claim 59, wherein said duct comprises a bottom plate extending between said tank outlet and said blower fan at said inlet side thereof, and said plate communicating with both of these; duct closing side walls on said plate extending up to said cover; said cover being over the top of said duct closing side walls; said bottom plate, said duct closing side walls and said cover closing and defining said duct.

64. The vacuum cleaner of claim 63, wherein said motor housing is secured to said cover, and said duct is thereby captured between said housing and said cover.

65. The vacuum cleaner of claim 64, further comprising a air flow rate regulator for said duct for blocking flow from said tank outlet to said blower fan to a selected extent.

66. The vacuum cleaner of claim 65, wherein said duct also communicates with the exterior of said tank and said power regulator divides a generally constant flow of air to said blower fan, between flow through said duct from said tank outlet and flow from outside said tank.

67. The vacuum cleaner of either of claims 63 or 66, wherein said blower fan inlet comprises a hole in said bottom plate that faces upwardly toward the top of said vacuum cleaner; said power regulator comprises a flange that is sweepable over that said hole for reducing the cross-sectional area of that said hole which is in direct communication with said duct.

68. A vacuum cleaner, comprising:

a suction inlet;

a blower fan in communication with said suction inlet for drawing air and other materials into said suction inlet; an outlet path for air from said blower fan; a motor for driving said blower fan; a housing for said blower fan motor; said blower fan being supported near the top of said housing;

a tank interposed between said suction inlet and said blower fan for receiving materials drawn in through said suction inlet; said tank having an inlet nozzle in communication with said suction inlet; an air outlet from said tank; said tank outlet being at a wall of said tank;

a duct connecting said tank outlet and said blower fan;

a cover above and spaced from the top of said housing;

said blower fan being adapted to expel air near and beneath said cover and means under said cover for deflecting the air from said blower fan through said cover; said cover including air passage means adapted to permit air to pass through it.

69. The vacuum cleaner of claim 68, further comprising a first vibration absorbing element interposed between outlet air from said fan and said cover so that air passing through said cover first passes through said first element.

70. The vacuum cleaner of claim 69, further comprising a second vibration absorbing and air velocity reducing element outside said cover so that air passing through said cover then passes between said second element and said cover;

an exhaust cover over said second element and secured to said cover for also holding said second element spaced from said cover.

71. The vacuum cleaner of either of claims 69 or 70, wherein the blower fan is a centrifugal fan;

said first element also having holes therethrough aligned beneath said holes in said cover.

72. The vacuum cleaner of claim 68, further comprising a vibration absorbing and air velocity reducing element outside said cover so that air passing through said cover then passes between said element and said cover.

73. The vacuum cleaner of either of claims 68, 69, 70 or 72, wherein said air passage means in said cover comprises holes through the cover.

74. The vacuum cleaner of claim 73, wherein the blower fan is a centrifugal fan.

75. The vacuum cleaner of claim 68, wherein said housing has a top with respect to the top of the vacuum cleaner and said blower fan is positioned near the top of said housing; said blower fan has an inlet side which faces upwardly toward the top of said vacuum cleaner; said tank having a top wall at the top thereof and said tank outlet being positioned at said top wall of said tank;

said duct extending between said top wall of said tank and said top of said housing, said duct being seated atop said tank top wall and also above said blower fan inlet side for joining said tank outlet and said blower fan inlet.

76. The vacuum cleaner of claim 68, said cover also extends over said tank for covering over both said housing and said tank;

sealing means located under said cover and positioned for preventing the air expelled by said blower fan beneath said cover from moving out from beneath said cover, whereby that air expelled by said blower fan exits by passing through said cover.

77. The vacuum cleaner of claim 76, wherein said sealing means comprises means for effecting substantial engagement between said blower fan motor housing and said cover at a location beneath said blower fan in said cover, thereby effectively prohibiting the passage of air expelled by said main blower fan past said means for effecting substantial engagement.

78. The vacuum cleaner of claim 77, wherein said sealing means extends over said tank and effects engagement between said tank and said cover when said cover is closed over said tank, thereby for inhibiting passage of air that is expelled by said main blower fan from moving out of said cover past said tank.

79. The vacuum cleaner of claim 78, wherein said housing has a top with respect to the top of the vacuum cleaner and said blower fan is positioned near said top of said housing; said blower fan has an inlet side which faces upwardly toward the top of said vacuum cleaner; said tank having a top wall at the top thereof and said tank outlet being positioned at said top wall of said tank;

said duct extending between said top wall of said tank and said top of said housing, said duct being seated atop said tank top wall and also above said blower fan inlet side for joining said tank outlet and said blower fan inlet.

80. The vacuum cleaner of either of claims 78 or 79, wherein said cover has a chamber defined therein across which said duct extends, in which said tank outlet is located and into which said blower fan projects; the portion of said cover including said chamber being the part of said chamber adapted to permit air to pass through it;

said sealing means being positioned for engaging and effectively engaging said cover for completely surrounding the side of said chamber opening toward said housing and said tank, thereby precluding air expelled from said main blower fan from exiting from said chamber.

81. The vacuum of claim 80, wherein said blower fan is a centrifugal fan.

82. The vacuum cleaner of claim 80, wherein said motor in said housing is enclosed in a motor casing and said casing is located in said motor housing; a cooling fan located in said casing for blowing cooling air over said motor; said casing having an inlet to said cooling fan and having an outlet placed so that air blown over said motor by said cooling fan will exit through said casing outlet;

said casing inlet and said casing outlet being placed such that said sealing means separates air expelled from said main blower fan under said cover from both said casing inlet and said casing outlet.

83. The vacuum cleaner of claim 77, wherein said motor in said housing is enclosed in a motor casing and said casing is located in said motor housing; a cooling fan located in said casing for blowing cooling air over said motor; said casing having an inlet to said cooling fan and having an outlet placed so that air blown over said motor by said cooling fan will exit through said casing outlet;

said casing inlet and said casing outlet being placed such that said sealing means separates air expelled from said main blower fan under said cover from both said casing inlet and said casing outlet.

* * * * *